US005451710A

United States Patent [19]

Shimizu

[11] Patent Number: 5,451,710

[45] Date of Patent: Sep. 19, 1995

[54] WAVEFORM SYNTHESIZING APPARATUS

[75] Inventor: Masahiro Shimizu, Hamamatsu, Japan

[73] Assignee: Yamaha Corporation, Hamamatsu, Japan

[21] Appl. No.: 114,604

[22] Filed: Aug. 31, 1993

Related U.S. Application Data

[63] Continuation of Ser. No. 531,907, Jun. 1, 1990, abandoned.

[30] Foreign Application Priority Data

Jun. 2, 1989 [JP] Japan ..... 1-140544
Jun. 2, 1989 [JP] Japan ..... 1-140545

[51] Int. Cl.[6] ..... G10H 7/00
[52] U.S. Cl. ..... 84/622; 84/625
[58] Field of Search ..... 84/615–620, 84/622, 625–633

[56] References Cited

U.S. PATENT DOCUMENTS 4,267,763 5/1981 Futamase et al. ..... 84/625 X
4,437,379 3/1984 Okumura ..... 84/65 X
4,566,364 1/1986 Katoh ..... 84/625
4,584,921 4/1986 Wachi .
4,706,537 11/1987 Oguri ..... 84/622 X
4,711,148 12/1987 Takeda et al. ..... 84/453 X
4,719,833 1/1988 Katoh et al. ..... 364/419 X
4,843,938 7/1989 Hideo ..... 84/DIG. 9
4,890,527 1/1990 Suzuki et al. ..... 84/697
4,893,538 1/1990 Masaki et al. ..... 84/622 X
4,939,973 7/1990 Suzuki ..... 84/605
4,957,032 9/1990 Hirano et al. ..... 84/622
5,105,709 4/1992 Suzuki ..... 84/615

*Primary Examiner*—William M. Shoop, Jr.
*Assistant Examiner*—Brian Sircus
*Attorney, Agent, or Firm*—Graham & James

[57] ABSTRACT

A waveform synthesizing apparatus provides a waveform memory containing m memory groups each further including n memories, so that the waveform memory contains m×n memories each storing at least one pair of musical tone data corresponding to a musical waveform. In addition, a musical parameter is converted into selection data in accordance with the predetermined conversion characteristic. At first, desirable one of the memory groups is selected. Then, two memories are selected from the selected memory group in accordance with the selection data. Thereafter, two pairs of musical tone data are mixed together by a ratio corresponding to the selection data. Thus, a synthesized musical waveform can be obtained from the mixed musical tone data. Preferably, the musical parameter is a key code, key-striking intensity applied to each key of a keyboard provided in an electronic musical instrument and the like.

12 Claims, 17 Drawing Sheets

FIG.1 *(PRIOR ART)*

WAVEFORM SYNTHESIZING APPARATUS

This is a continuation of application Ser. No. 07/531,907, filed on Jun. 1, 1990, now abandoned.

BACKGROUND OF THE INVENTION

1. Field of the Invention

The present invention relates to a waveform synthesizing apparatus which synthesizes waveform data read from plural waveform memories so as to generate a musical tone signal.

2. Prior Art

In the conventionally developed electronic musical instrument, waveform data picked up from a non-electronic musical instrument and the like are stored in a waveform memory for a predetermined period and then such waveform data are read out so as to generate the musical tone. Fundamentally, such electronic musical instrument provides one waveform memory for one tone color so that the waveform data is read out in response to the period corresponding to the pitch of the operated key. In most of the non-electronic musical instruments, a slightly different waveform is picked up with respect to each of the higher tone area, middle tone area and lower tone area or with respect to each tone volume. For this reason, if the musical tone is formed by use of the same waveform data, the musical tone must be heard un-naturally and monotonously. Thus, another electronic musical instrument has been developed which provides plural waveform memories each storing different waveform data with respect to each tone area or each tone volume as shown in FIG. 1.

In FIG. 1, the whole tone area of a keyboard 1 is divided into several small tone areas each corresponding to the predetermined number of keys. Then, there are provided five waveform memories M0, M1, M2, M3, M4 each storing a different waveform, wherein each small tone area is assigned to each waveform memory. In each small tone area, the musical tone is to be formed based on the different waveform data stored in each waveform memory. When setting plural tone colors, the memory construction as shown in FIG. 1 is provided with respect to each tone color. In this case, the number of waveform memories may be different among some tone colors.

Meanwhile, there is a problem in that sounds of the electronic musical instrument as shown in FIG. 1 may be heard un-naturally because the waveform is changed remarkably between two keys corresponding to different tone areas respectively. In order to avoid such problem, the waveform data stored in two neighboring waveform memories are mixed together according to needs, so that the waveform is naturally varied at the boundary between the two neighboring tone areas in response to the change of tone area to be used.

In the case of the piano, the waveform must differ for each string-striking intensity. Thus, the electronic musical instrument capable of generating piano sounds provides plural waveform memories each corresponding to each of the touch intensities to be applied to the keys.

In order to obtain the delicate variation of the waveforms to be generated with respect to certain tone areas (e.g., higher tone area or lower tone area) of the keyboard, the number of waveform memories to be assigned to a certain tone area is set larger than that of the waveform memories to be assigned to other tone areas. In addition, once the above-mentioned keyboard characteristic is set, such keyboard characteristic is maintained even if the number of waveform memories is changed when changing over the tone color. That is because there is a tendency for the performer to play keyboard in consideration of its keyboard characteristic. Therefore, if the keyboard characteristic is changed in response to the change-over of the tone color, the expected performance effect cannot be obtained.

However, in the conventional electronic musical instrument, the waveform memory assignment is determined in advance in accordance with the number of waveform memories to be provided. Thus, there is a problem in that if the tone color is changed over, the waveform variation characteristic to be set to the keyboard must be varied, regardless of the performer's expectation.

SUMMARY OF THE INVENTION

It is accordingly a primary object of the present invention to provide a waveform synthesizing apparatus which can smoothly change the waveforms when the pitch or touch is changed over.

It is another object of the present invention to provide a waveform synthesizing apparatus which can set the arbitrary waveform variation characteristic of the keyboard, regardless of the number of waveform memories to be set with respect to each tone color.

In one embodiment of the present invention, a waveform synthesizer is provided which includes a memory for storing musical tone data. The memory includes a number M of memory groups, each of which includes a number N of memories. M and N are integers and N may vary between different groups. Each of the N memories stores one or more sets of musical tone data. The synthesizer includes a first selector for selecting one of M memory groups and an input device for inputting a musical parameter. A conversion mechanism is provided for converting the input musical parameter in accordance with a predetermined conversion characteristic in order to generate selection data having a value in a predetermined range. A multiplier multiplies the selection data by a number which represents the number N of memories belonging to the memory group selected by the selector, with the multiplication result having an integer part and a decimal part. A second selector selects two of the memories contained within the memory group selected by the first selector in accordance with the integer part of the multiplication result. A portion of the predetermined range of selection data which corresponds to one of the N memories is variable in accordance with the multiplication result. The assignment density of different waveform data is variable over the predetermined range. Two sets of musical tone data are read from the two memories selected by the second selector and are combined in accordance with the decimal part of the multiplication result to obtain a synthesized waveform.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
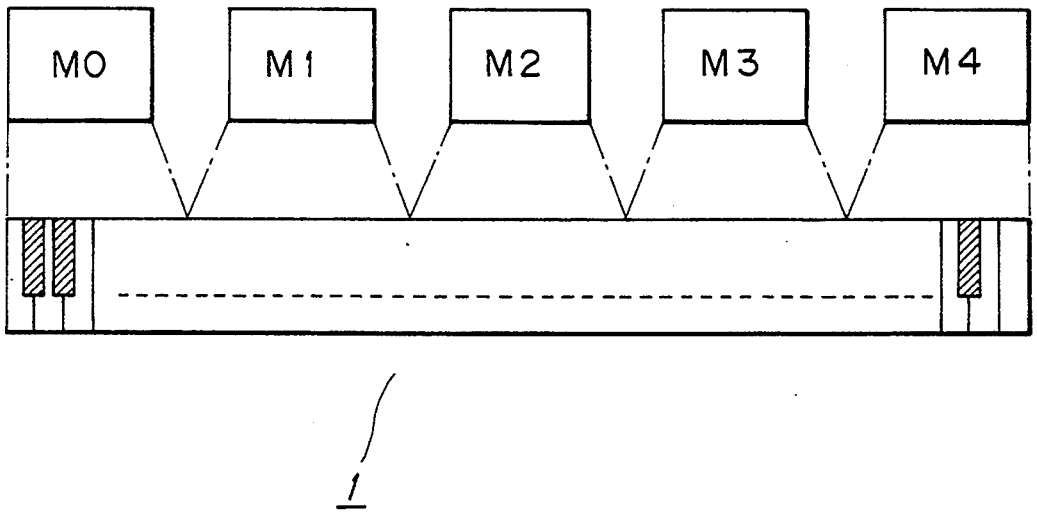
FIG. 1 shows an example of the waveform memory assignment of the keyboard in the conventional electronic musical instrument.

Next, description will be given with respect to the preferred embodiments of the present invention by referring to the drawings, wherein like reference characters designate like or corresponding parts throughout several views.

[A] FIRST EMBODIMENT (1) Whole Configuration

Figure 2:
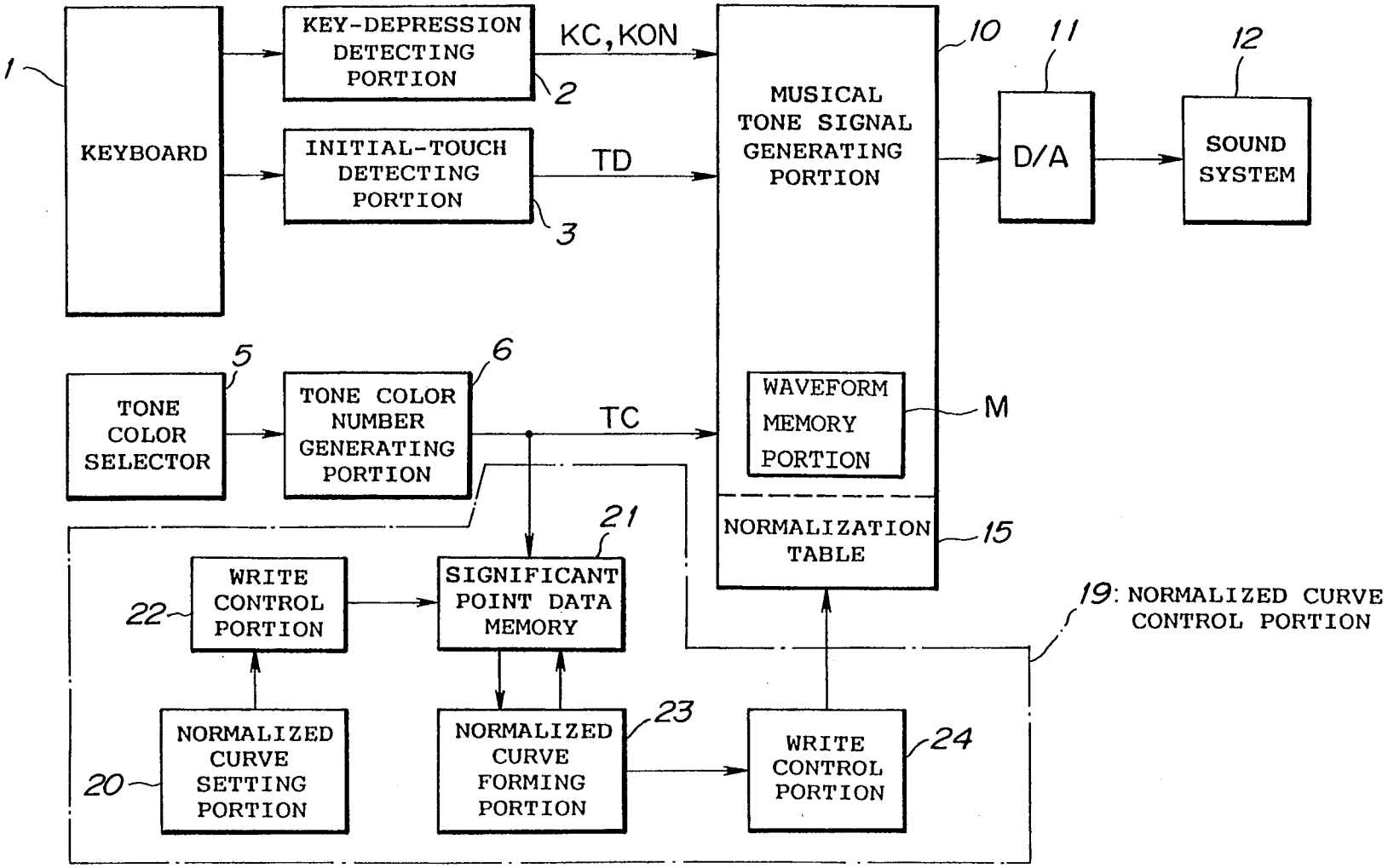
FIG. 2 is a block diagram showing an electrical schematic of the electronic musical instrument employing the waveform synthesizing apparatus according to a first embodiment of the present invention.

FIG. 2 is a block diagram showing the whole configuration of the electronic musical instrument employing the waveform synthesizing apparatus according to the first embodiment of the present invention. In FIG. 2, 1 designates a keyboard consisting of plural keys, and each key operation is detected by a key-depression detecting portion 2. This key-depression detecting portion 2 outputs a key-on signal KON indicating the key-depression event and a key code KC indicative of the pitch of the depressed key. An initial-touch detecting portion 3 detects the initial-touch of the depressed key to thereby generate and output touch data TD. In addition, 5 designates a tone color selector, and 6 designates a tone color number generating portion. When the output of tone color selector 5 is supplied to the tone color number generating portion 6, the tone color number generating portion 6 generates a tone color designating signal TC.

Next, 10 designates a musical tone signal generating portion which contains a waveform memory portion M therein. Then, a corresponding one of the waveforms stored in the waveform memory portion M is read out in response to the touch data TD, tone color designating signal TC and key code KC. Based on the read waveform, the musical tone signal generating portion 10 generates the musical tone signal, which is then supplied to a sound system 12 via a digital-to-analog (D/A) converter 11. Thus, the sound system 12 can generate the corresponding musical tone.

Further, 19 designates a normalized curve control portion which forms a normalized curve to be written into a normalization table 15. A detailed description of the normalized curve control portion 19 will be given later.

(2) Configuration and Operation of Each Circuit

Next, a detailed description will be given with respect to each of the above-mentioned circuit portions shown in FIG. 2.

(a) Waveform Memory Portion M

Figure 3:
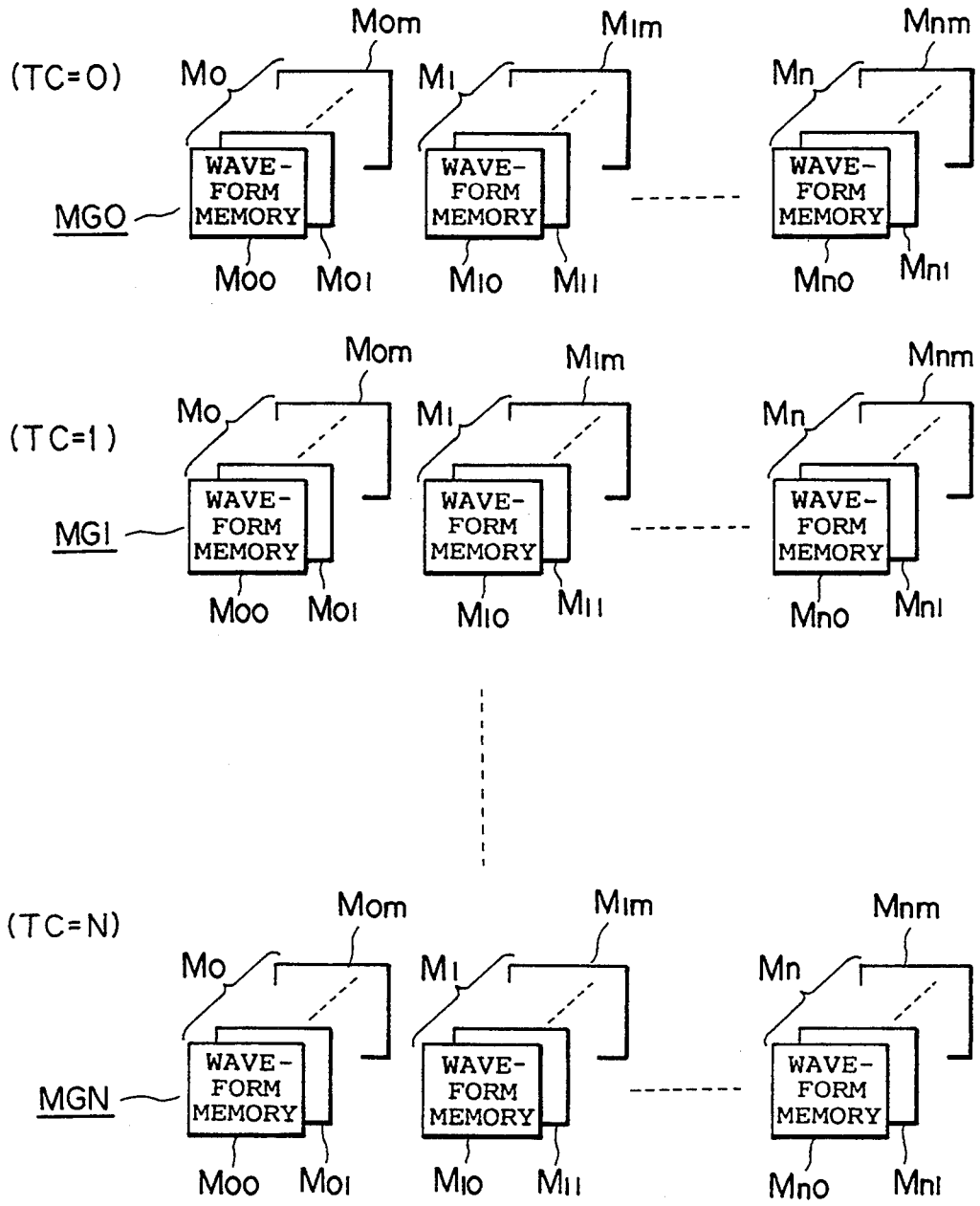
FIG. 3 is a conceptual image illustrating the detailed configuration of a waveform memory portion shown in FIG. 2.

As shown in FIG. 3, the waveform memory portion M includes plural memory groups MG1 to MGN each storing each of the waveforms corresponding to the tone color number TC (where TC=0 to N). In addition, each memory group MGi (where i=0 to N) includes waveform memory blocks M0 to Mn each storing a different waveform with respect to each of the tone areas. The reason why a different waveform is stored in each waveform memory block with respect to each tone area is that the waveform generated from the same musical instrument (e.g., piano) must be slightly differed when the used tone area is changed. Herein, the number of waveform memory blocks is arbitrarily set with respect to each tone color. Further, each waveform memory block includes plural waveform memories $M_{ij}$ each storing a waveform which is different with respect to each key-striking intensity. The reason why the present embodiment employs the complicated waveform memory configuration is that the waveform can be differed with respect to the key-striking intensity (i.e., sound intensity) even in the same tone color and same tone area. Each waveform memory is selected by the touch data TD. Incidentally, the value j is arbitrarily set with respect to each tone color.

Figure 4:
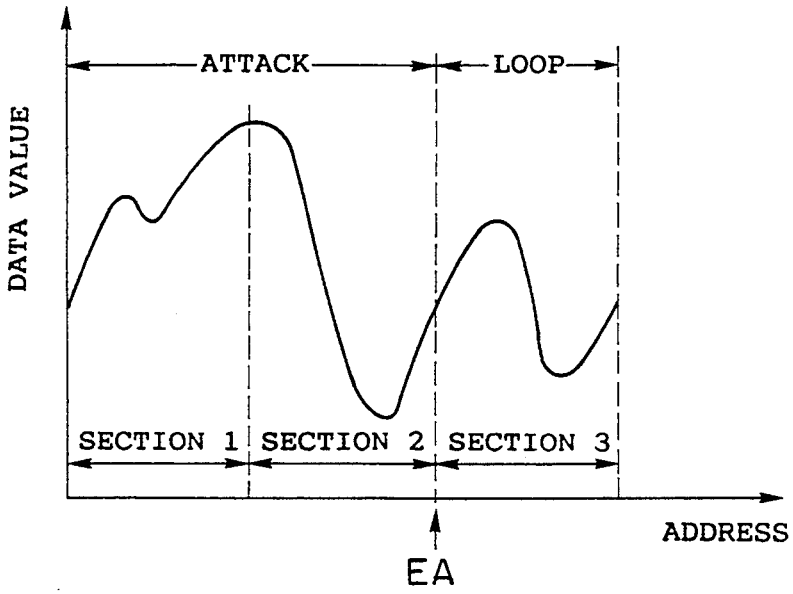
FIG. 4 shows an example of the waveform to be stored in the waveform memory of the first embodiment.

Next, description will be given with respect to the waveform stored in each waveform memory $M_{ij}$ (where i=0 to n, j=0 to m) by referring to FIG. 4. In FIG. 4, the waveform is divided into three sections as shown by dotted lines, wherein each section corresponds to the predetermined reading period. Herein, the first and second sections correspond to the attack portion of the waveform, while the third section corresponds to the loop portion of the waveform. The attack portion is defined as the rising-up portion of the waveform. After reading out the attack portion, the loop portion will be read out. Thereafter, the loop portion is repeatedly read out. More specifically, after completely reading out the first and second sections of the waveform, the third section of the waveform is to be read out. Incidentally, the number of sections included in the attack portion is determined in response to the tone color, tone area, key-striking intensity and the like.

(b) Normalization Table 15

Figure 5:
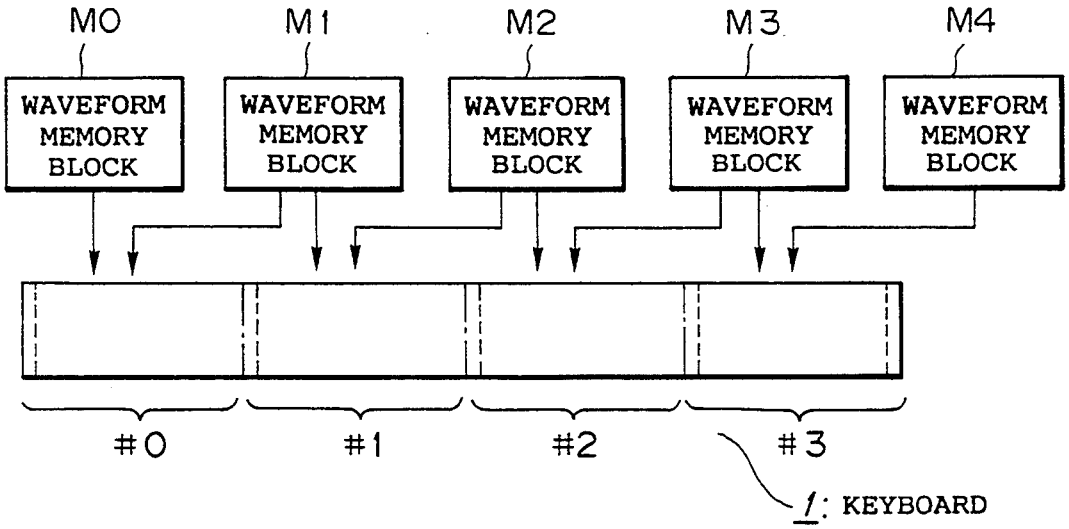
FIGS. 5 and 6 show an example of the waveform memory assignment employed by the first embodiment.
Figure 6:
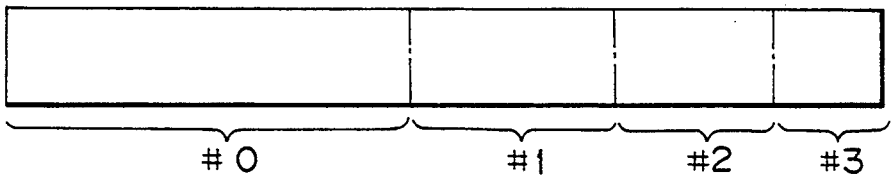

The normalization table 15 is used to assign an arbitrary tone area to any one of the waveform memories. Next, description will be given with respect to such waveform memory assignment process by referring to FIG. 5. In FIG. 5 which shows the memory group MG1 as an example, the number n is set at "4" so that there are five waveform memory blocks M0 to M4 in the memory Group MG1.

At first, the waveform memory blocks M0 to M4 are respectively assigned to the keys from the lower tone area in pitch-ascending-order. Herein, the whole key area (i.e., whole tone area) of the keyboard 1 is divided into four key areas #0 to #3, where #0 is the lowest and #3 is the highest in pitch. In this case, two waveform memory blocks are assigned to one key area such that the waveform memory blocks M0, M1 are assigned to the lowest key area #0; M1, M2 are assigned to #1; M2, M3 are assigned to #2; and M3, M4 are assigned to #3. In the present embodiment, the key range (i.e., number of keys) is determined with respect to each key area as follows.

First, under operation of the normalization table 15 shown in FIG. 2, the value of key code KC is converted into the value ranging from "0" to "1". Then, value of "[memory block number]−1" is multiplied by the converted value of key code KC. In the multiplication result, the integer part is designated by "a", while the decimal part is designated by "b". In other words, if the converted value of key code KC is designated by "CDA", the following formula (1) can be established.

$$CDA \times ([\text{memory block number}]-1)=X \quad (1)$$

where X designates the multiplication result including the integer part "a" and decimal part "b" (=X−a).

Figure 7A:
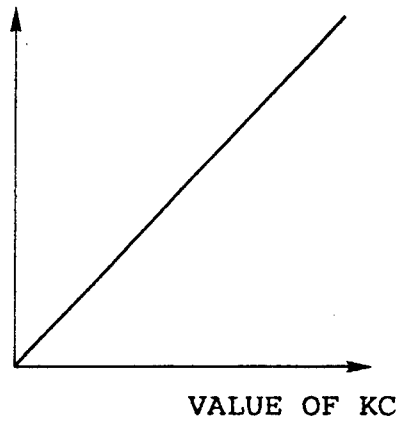
FIGS. 7A, 7B, 8A, 8B show the normalized curve and method of reproducing the same.
Figure 7B:
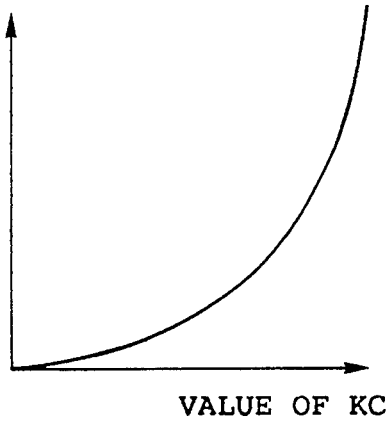

Based on the integer value "a", two waveform memory blocks Ma, M(a+1) are selected. Thus, in response to the integer value "a" which varies in accordance with the key code KC, the range of the key area is determined. In other words, the normalized curve can determine the assignment of the waveform memory blocks M0 to M4 each assigned to each tone area. For example, in case of the linear conversion curve as shown in FIG. 7A, the waveform memory blocks are assigned to the tone areas with an even rate. In contrast, when the normalized curve is set as shown in FIG. 7B, the waveform memory blocks are assigned to the higher tone area rather than the lower tone area with a high rate. In short, the range of the lowest key area #0 is set broader as compared to the ranges of the higher key areas #2, #3.

Figure 9:
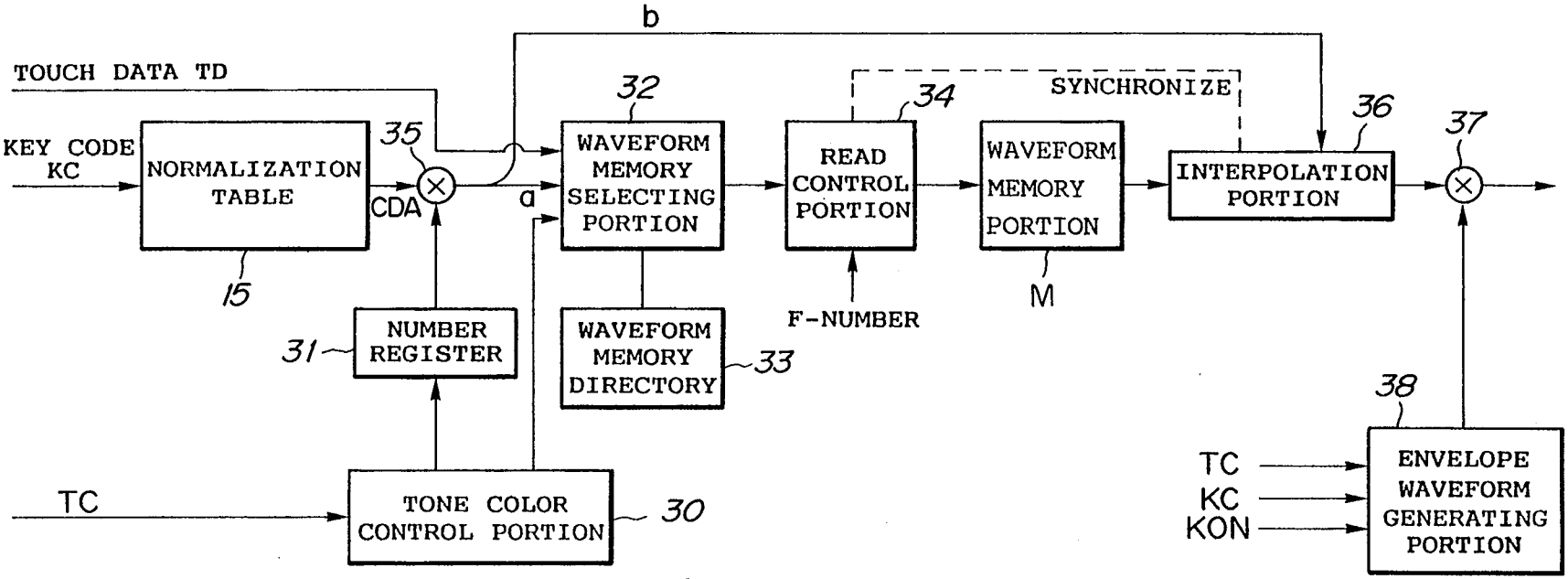
FIG. 9 is a block diagram showing the detailed configuration of a musical tone signal generating portion shown in FIG. 2.

The operation of the foregoing formula (1) is carried out in the musical tone signal generating portion 10 shown in FIG. 2. FIG. 9 is a block diagram showing the detailed configuration of the musical tone signal generating portion 10. In FIG. 9, a tone color control portion 30 outputs a selection signal for selecting any one of the memory groups MG0 to MGN in response to the tone color designating signal TC supplied thereto, wherein this selection signal is supplied to a waveform memory selecting portion 32. In addition, the tone color control portion 30 also calculates the value which is obtained by subtracting "1" from the number of waveform memory blocks contained in the selected memory group, and then the calculated value is written into a number register. Next, 35 designates a multiplier which multiplies the output CDA of normalization table 15 by the output of number register 31. This multiplication performed by the multiplier 35 corresponds to the foregoing operation (1). Then, the multiplication result includes upper data and lower data corresponding to the integer part "a" and decimal part "b" respectively. Herein, upper data is defined as upper bits (e.g., leftmost nybble), while lower data is defined as lower bits (e.g., rightmost nybble).

Due to the operation (1), two waveform memories are selected, and then the two waveform data read from the two waveform memories are mixed together by the following operation (2).

$$(1-b)W_a+b\,W_{a+1} \quad (2)$$

Herein, $W_a$, $W_{a+1}$ designate the waveform data respectively read from the waveform memory blocks $M_a$, $M_{a+1}$ corresponding to the touch data TD. According to the above-mentioned operation (2), the value of $W_a$ affects the mixed waveform data as the pitch becomes lower in a certain tone area, while the value of $W_{a+1}$ affects the mixed waveform data as the pitch becomes higher in a certain tone area. When the pitch is the lowest in a certain tone area, the value of "b" is equal to "0" so that the waveform is formed by use of the waveform data $W_a$ only. In case of the highest pitch, the output CDA of normalization table 15 becomes equal to "1" so that the result of the foregoing operation (1) is as follows:

$$1\times 4=4$$

In this case, "a" is at "4" and "b" is at "0". Thus, the waveform memory blocks M4, M5 are selected. However, since "b" is at "0", the musical tone will be formed by use of waveform data W4 stored in the waveform memory block M4 only due to the foregoing operation (2). In short, the waveform memory block M5 is omitted, but no problem occurs by employing the operation (2). In FIG. 5, dotted lines indicate the keys from which musical tone is formed by use of the waveform data $W_a$ only. Incidentally, the operation (2) is carried out by an interpolation portion 36, which will be described later by referring to FIG. 9.

(c) Normalized Curve Control Portion 19

Figure 8A:
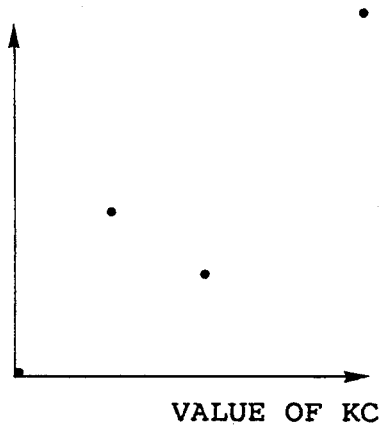
Figure 8B:
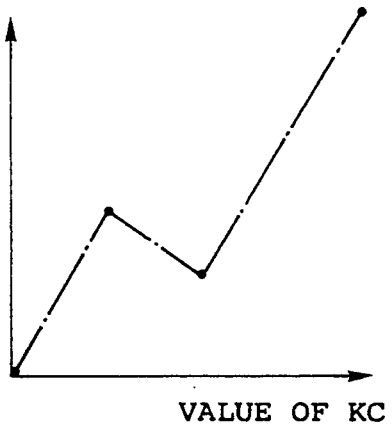

Next, description will be given with respect to the normalized curve control portion 19 by referring to FIG. 2. In FIG. 2, 20 designates a normalized curve setting portion which is operated when setting the normalized curve in the normalization table 15. In addition, 21 designates a significant point data memory which stores data at four significant points specifying the normalized curve as shown in FIG. 8A. These significant points are written into the significant point data memory 21 by a write control portion 22 based on the output of normalized curve setting portion 20. In addition, the significant point data memory 21 is designed to store the significant point by each tone color corresponding to the tone color designating signal TC supplied thereto. In this case, the significant point data memory 21 can store the same significant point with respect to different tone colors.

Next, 23 designates a normalized curve forming portion which forms the normalized curve by the interpolation operation based on the data at the significant points stored in the significant point data memory 21. For example, the normalized curve forming portion 23 forms the normalized curve by the linear interpolation operation as shown in FIG. 7A. This normalized curve is formed when a command signal is supplied to the normalized curve forming portion 23, wherein this command signal is generated in accordance with the performer's operation when the performance is to be started, for example. Instead of the linear interpolation, it is possible to carry out the interpolation operation by use of the secondary or tertiary curve. Then, the normalized curve formed by the above-mentioned normalized curve forming portion 23 is written into the normalization table 15 under operation of a write control portion (d) Waveform Memory Selecting Portion 32

The waveform memory selecting portion 32 refers to a waveform memory directory 33 to thereby select the waveform memory $M_{ij}$ based on the touch data TD, upper output "a" of multiplier 35 and memory group selecting signal supplied from the tone color control portion 30. Then, the waveform memory selecting portion 32 outputs the data representative of the head address etc. of the selected waveform memory $M_{ij}$ to a read control portion 34.

Figure 10:
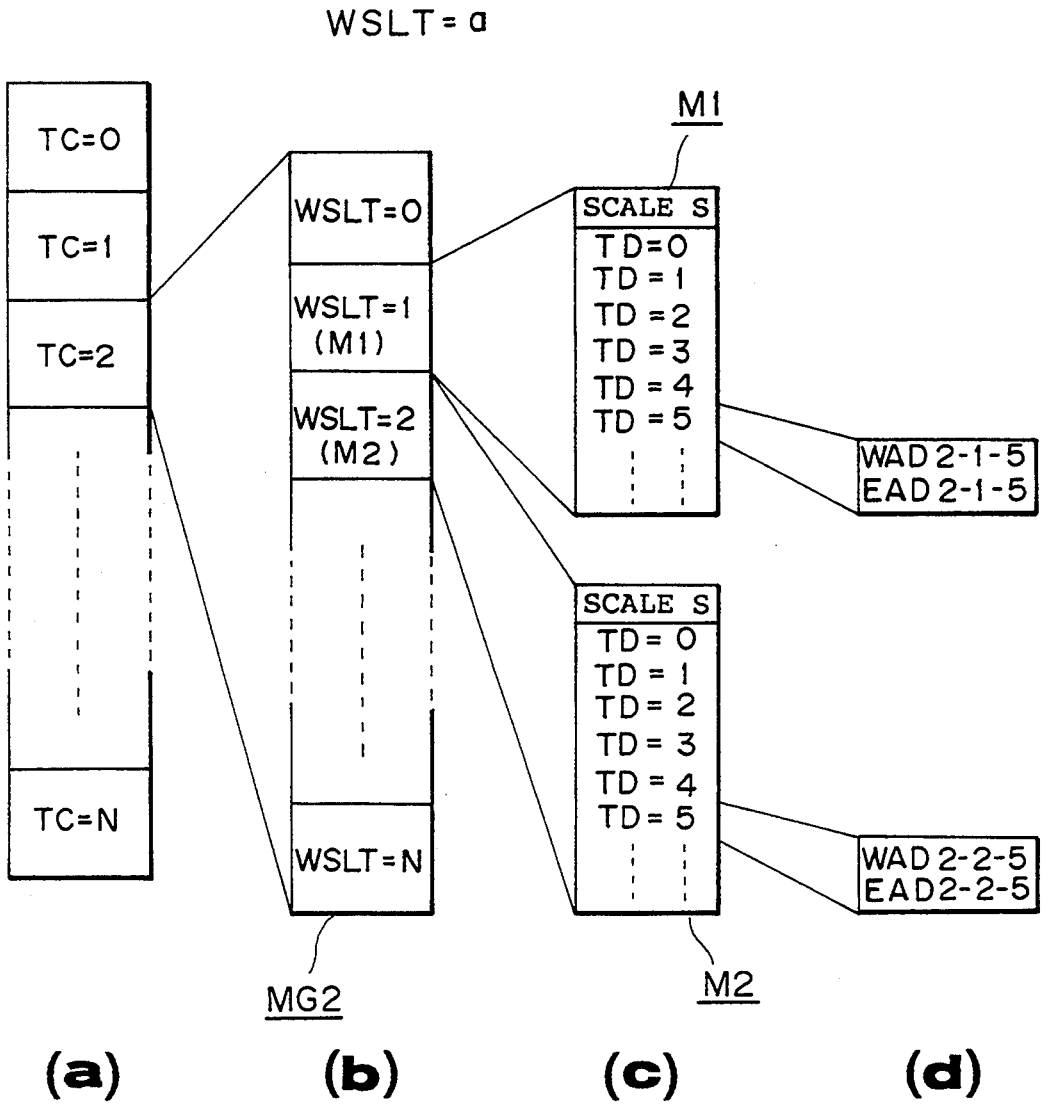
FIG. 10 is a conceptual image illustrating the memory selecting process of the first embodiment.

Hereinafter, description will be given with respect to the memory selecting process of waveform memory selecting portion 32 which is carried out by referring to the waveform memory directory 33. For example, if the value of tone color control signal TC is at "2", the corresponding waveform memory group MG2 is selected as shown in FIG. 10(*b*). Then, the upper output "a" of the multiplier 35 is set as a memory block designating signal WSLT, by which the memory block is selected. When the memory block designating signal WSLT is at "1", two memory blocks M1, M2 are selected (see FIG. 10(*c*)). As described before, each of the memory blocks M1, M2 includes plural waveform memories corresponding to the touch data TD (see FIG. 3). In addition, the scale data S is stored in each memory block M.

Next, description will be given with respect to the scale data S representative of the memory scale. Herein, the waveform data is stored in the waveform memory $M_{ij}$ as shown in FIG. 4. The read-out of the waveform data is made by every period corresponding to the key code KC. More specifically, the read-out period is set smaller as the pitch indicated by the key code KC becomes higher, thus the sound frequency is raised up. For this reason, data density of the waveform data is small in the higher tone area as compared to the lower tone area. This means that the memory capacity can be reduced in the higher tone area. Thus, the memory scale of the waveform memory is set smaller as the tone area becomes higher, so that the address number is set smaller in the higher tone area. Therefore, when carrying out the waveform data from the waveform memory, the address data must be set in accordance with the memory scale of the waveform memory. In order to generate the address data corresponding to the memory scale, the scale data S is stored in each memory block.

Thereafter, as shown in FIG. 10(*d*), one waveform memory is selected from each of the memory blocks M1, M2 based on the touch data TD. FIG. 10(*d*) shows the case where the touch data TD is at "5". Herein, "WAD 2-1-5" indicates the head address of the waveform memory under the condition where the tone color number is at "2", WLT(="a") is at "1" and touch data TD is at "5". In addition, "EAD 2-1-5" indicates the end address under the same condition described above. The end address indicates the end portion of the attack portion of the waveform. For example, this end address can be indicated by "EA" shown in FIG. 4. Similarly, "WAD 2-2-5", "EAD 2-2-5" indicate the head address and end address respectively.

As described heretofore, two waveform memories are selected, and then the waveform memory selecting portion 32 outputs the data indicative of the head addresses, end addresses and scale data S corresponding to the selected waveform memories.

(e) Read Control Portion 34

Figure 11:
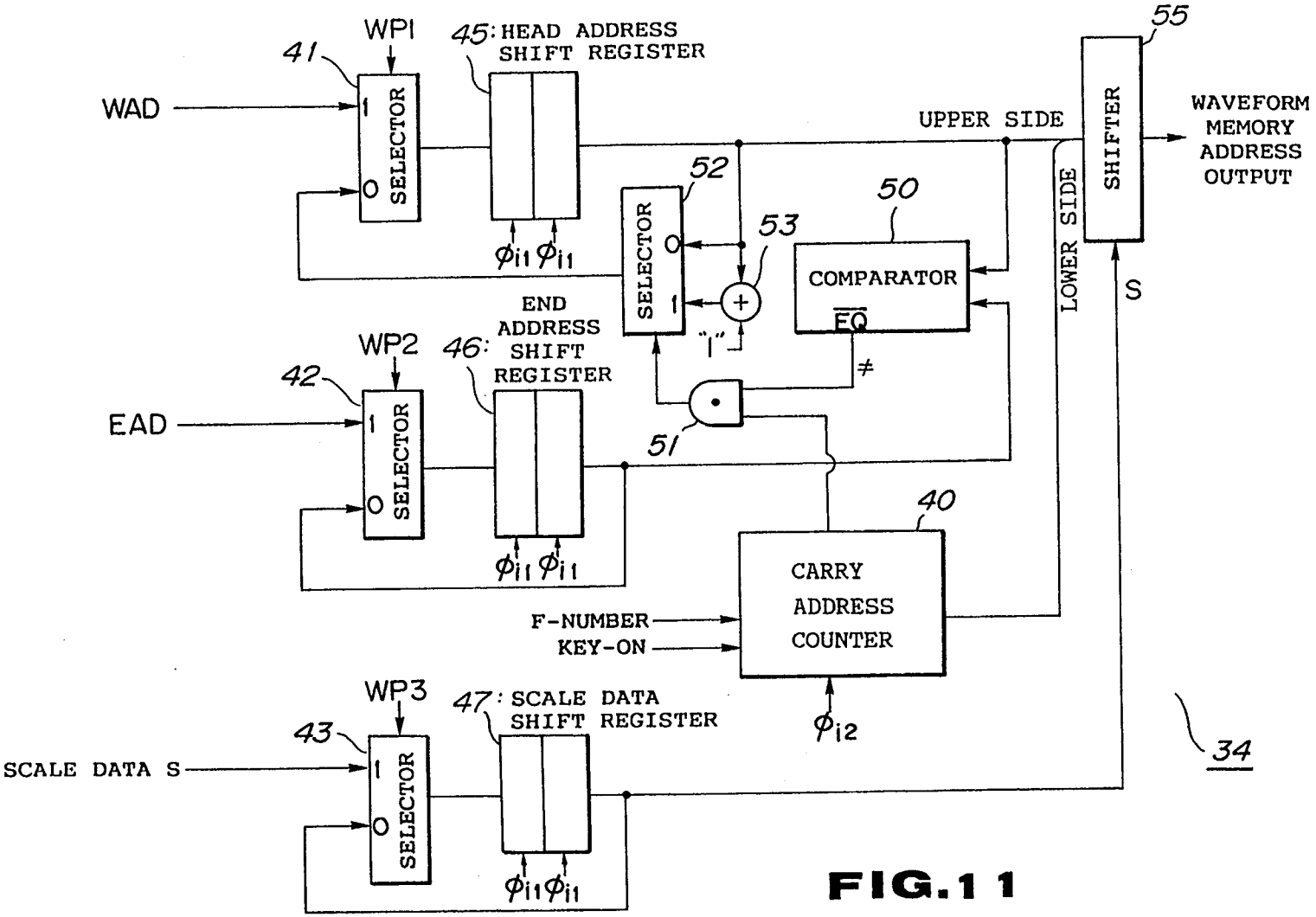
FIGS. 11 is a block diagram showing the detailed configuration of a read control portion shown in FIG. 9.

The read control portion 34 functions to read the waveform data from the waveform memory $M_{ij}$, wherein this read control portion 34 is constructed as shown in FIG. 11. In FIG. 11, 40 designates an address counter which accumulates the F-number in synchronism with clock $\phi_{i2}$ after the key-on signal KON is supplied thereto. Then, the accumulation result of the address counter 40 is output as the lower data of its address data. Herein, the F-number is defined as the data indicating the frequency corresponding to the pitch of the key code KC. The waveform memory selecting portion 32 shown in FIG. 9 outputs head address data WAD, end address data EAD and scale data S to first bit input terminals (represented by "1") of selectors 41, 42, 43 respectively. When signals wp1, wp2, wp3 are supplied to the selectors 41, 42, 43 respectively, the data supplied to their first bit input terminals are selected. These signals wp1, wp2, wp3 are generated when several data output from the waveform memory selecting portion 32 are written into the read control portion 32. Next, a head address shift register 45 shifts the head address WAD from the selector 41 in synchronism with clock $\phi_{i1}$. Herein, clock $\phi_{i1}$ has a half period of clock $\phi_{i2}$. Similar to the head address shift register 45, an end address shift register 46 and a scale data shift register 47 carry out the shift operations in synchronism with clock $\phi_{i1}$. Each of these shift registers 45, 46, 47 is constructed by a two-stage shift register consisting of first and second stages. Thus, the end address shift register 46 shifts the end address data EAD from the selector 42, while the scale data shift register 47 shifts the scale data S from the selector 42. The outputs of the end address shift register 46 and scale data shift register 47 are fed back to second bit input terminals (represented by "0") of the selectors 42, 43.

Next, 50 designates a comparator which compares the output of head address shift register 45 with the output of end address shift register 46. When both of the head address data and end address data coincide with each other, the comparator 50 outputs "0" signal. An AND gate 51 carries out an AND operation on the output of comparator 50 and carries the signal output from the address counter 40. Then, the output of AND gate 51 is supplied to a control terminal of selector 52. This selector 52 receives an output of adder 53 at its first bit input terminal (represented by "1") and the output of head address shift register 45 at its second bit input terminal (represented by "0"). The adder 53 adds "1" to the output of head address shift register 45. Then, the output of selector 52 is fed back to second bit input terminal (represented by "0") of the selector 41.

The output of head address shift register 45 is used as the upper side of the address data, while the output of address counter 40 is used as the lower side of the address data. Thus, a shifter 55 combines these data together to thereby form the address data, which is supplied to the waveform memory $M_{ij}$ in the waveform memory portion M. Herein, the shifter 55 shifts the address data in the lower side by the bits corresponding to the scale data S.

Next, description will be given with respect to the operation of the read control portion 34. First, the head address data (i.e., read-out address data) WAD, end address data EAD and scale data S for the waveform memory corresponding to the memory block designating signal WSLT(="a") are respectively supplied to and stored in first stages of the head address shift register 45, end address shift register 46 and scale data shift register 47 via the selectors 41, 42, 43. Then, the shift registers 45, 46, 47 shift their input data WAD, EAD, S to their second stages respectively. In addition, other data WAD, EAD, S for another waveform memory corresponding to another memory block designating signal WSLT(="a"+1) are stored in the first stages of the shift registers 45, 46, 47 respectively. As a result, the shifter 55 outputs the address data indicating the head address of the waveform memory corresponding to WSLT(="a"), and the shift value thereof corresponds to the address number of this waveform memory. When next clock $\phi_{i1}$ is given, each of the shift registers 45, 46, 47 carries out the shift operation. Thus, the shifter 55 outputs the address data indicating the head address of the waveform memory corresponding to WSLT(="a"+1), and the shift value thereof corresponds to the address number of this waveform memory. The output at the second stage of the head address shift register 45 is fed back to its first stage via the selectors 52, 41. Similarly, the output at the second stage of the scale data shift register 47 is fed back to its first stage via the selector 43. Thereafter, every time the clock $\phi_{i1}$ is given, the address data output from the shifter 55 alternately corresponds to WSLT(="a"), WSLT(="a"+1).

Meanwhile, every time two clocks $\phi_{i1}$ are generated, one clock $\phi_{i2}$ is generated. Thus, the address counter 40 accumulates the F-number. Herein, the output of address counter is used as the lower side of the address data, which is renewed once every time two clocks $\phi_{i1}$ are generated.

Next, when the address counter 40 overflows, a carry signal CY is output so that the AND gate 51 outputs "1" signal. As a result, the first bit input terminal (represented by "1") of the selector 52 is selected, so that the output of adder 53 is supplied to the first stage of the head address shift register 45 via the selectors 52, 41. Thus, the upper side of the address data is incremented by "1". Such increment is made every time the address counter 40 overflows so that the carry signal CY is output therefrom. Under the above-mentioned operations, several waveform sections of the attack portion (see FIG. 4) are sequentially read out. Thereafter, when the incremented upper side of the address data coincides with the end address data EAD output from the second stage of the end address shift register 46, the comparator 50 outputs the "0" signal so that the AND gate 51 is in the closed stage from now on. Under the state where the AND gate 51 is closed, the AND gate 51 does not output the "1" signal even if the carry signal CY is supplied thereto. As a result, the selector 52 selects its second bit input terminal (represented by "0"). Thus, the addition operation of the adder 53 is canceled, so that the upper side of the address data is not incremented any more. In such state, only the lower side of the address data is varied, so that the loop portion of the waveform (see FIG. 4) is repeatedly read out. Incidentally, the comparator 50 alternately carries out the comparison operation on the two end address data EAD from the end address shift register 46 for the two waveform memories corresponding to WSLT(="a"), WSLT(="a"+1). Therefore, the read-out control in which the read waveform portion is changed from the attack portion to the loop portion is carried out by each waveform memory. As described heretofore, the read control portion 34 alternately outputs two address data for two waveform memories selected by the waveform memory selecting portion 32. When such address data is supplied to the waveform memory portion M, the waveform data are sequentially read from the corresponding waveform memory within the waveform memory portion M.

(f) Interpolation Portion 36

Figure 12:
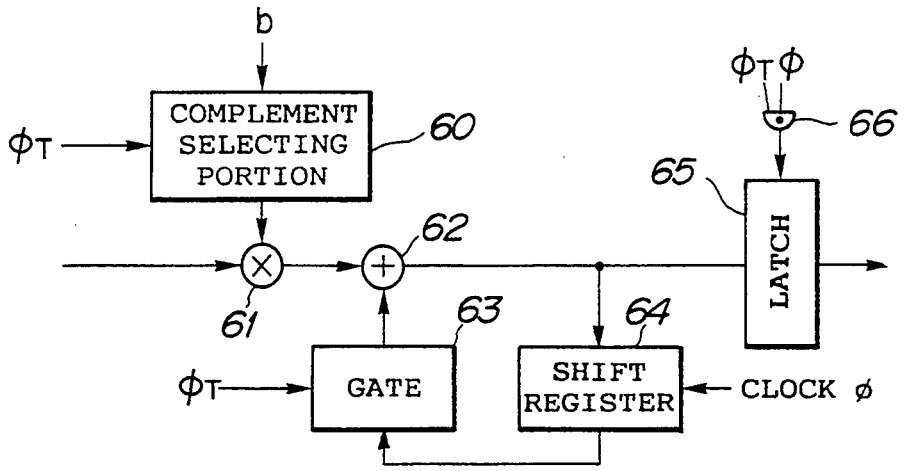
FIG. 12 is a block diagram showing the detailed configuration of an interpolation portion shown in FIG. 9.

The interpolation portion 36 shown in FIG. 9 carries out the interpolation operation on the waveform data read from the waveform memory portion M. FIG. 12 shows the detailed construction of this interpolation portion 36. In FIG. 12, the lower data (i.e., "b") output from the multiplier 35 is supplied to a complement selecting portion 60, from which the value "b" itself or the complement thereof is selectively output. Herein, when clock $\phi_T$ is at "0", the complement selecting portion 60 selectively outputs the complement of "b" which is nearly equal to the value (1−b). If "1" is added to the lowest bit of this complement, the addition result perfectly coincides with the value (1−b).

Figure 13:
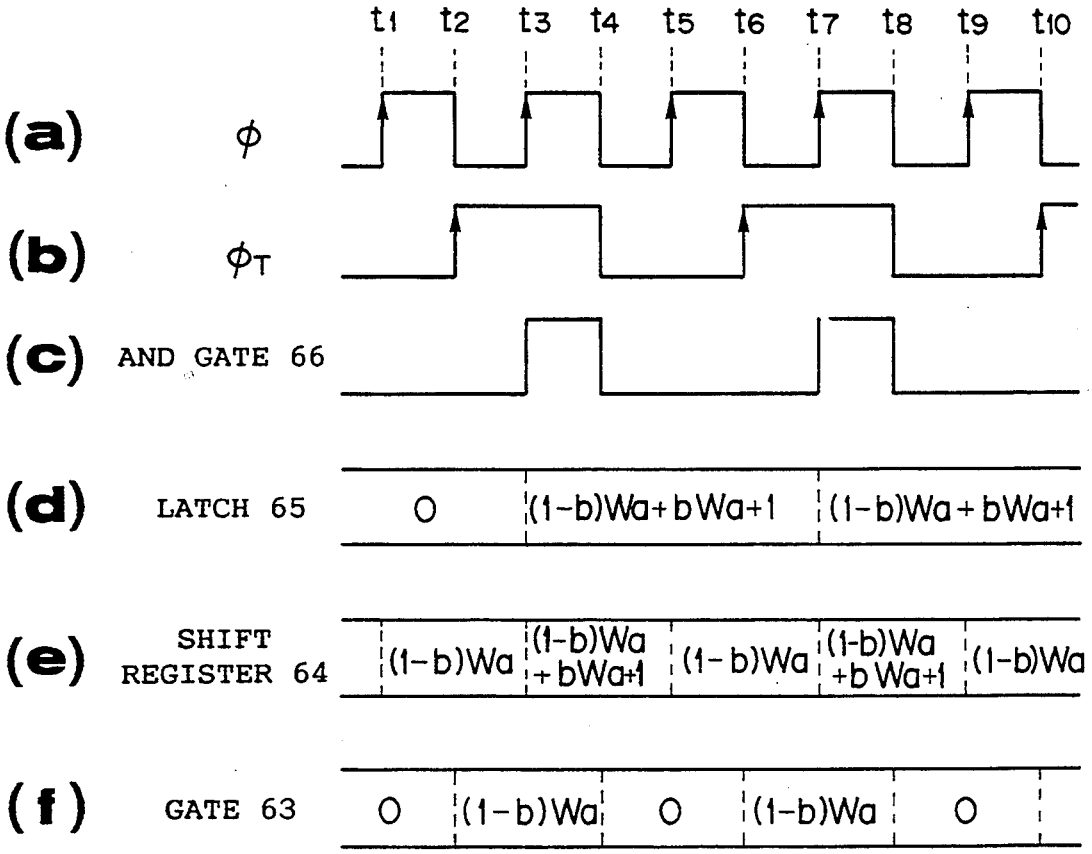
FIG. 13 is a timing chart showing operations of the interpolation portion.

Next, a multiplier 61 multiplies the output of complement selecting portion 60 by the waveform data $W_a$, $W_{a+1}$ which are alternately read from the waveform memory portion M. Then, an adder 62 adds the multiplication result of multiplier 61 to an output of gate 63. In addition, 64 designates a shift register which stores the output of adder 62 in synchronism with clock $\phi$. The output of this shift register 64 is supplied to the gate 63. Further, 65 designates a latch which latches the output of adder 62. Herein, when an output of AND gate 66 is at "1", the latch 65 latches the output of adder 62. Incidentally, the AND gate 66 carries out the AND operation on clocks $\phi$, $\phi_T$. In this case, clock $\phi$ has the same frequency of clock $\phi_{i1}$ so that clock $\phi$ is generated in synchronism with clock $\phi_{i1}$ (see FIG. 13(*a*)). In addition, clock $\phi_T$ has the double period of clock $\phi$, and relation between these clocks $\phi$ and $\phi_T$ is as shown in FIGS. 13(*a*), 13(*b*).

Next, description will be given with respect to the operation of the above-mentioned interpolation portion 36. At first time $t_1$ in FIG. 13 when the waveform data $W_a$ is read from the waveform memory portion M, the read waveform data $W_a$ is multiplied by the output of complement selecting portion 60. Since clock $\phi_T$ is represented as the "0" signal at time $t_1$, the output of complement selecting portion 60 is equal to (1−b). As a result, the multiplication result of multiplier 61 can be represented as $W_a(1-b)$. Such multiplication result is supplied to the shift register 64 and latch 65 via the adder 62. At time $t_1$, both of the outputs of AND gate 66 and gate 63 are at "0" level (see FIGS. 13(*c*), 13(*f*)). Thus, the adder 62 does not operate, and the latch 65 does not operate either. Meanwhile, since clock $\phi$ rises up at time $t_1$, the shift register 64 inputs the multiplication result $W_a(1-b)$ (see FIG. 13(*e*)). At next time $t_2$ when clock $\phi_T$ rises up, the gate 63 is opened so that the shift register 64 outputs the value $W_a(1-b)$ via the gate 63. In addition, the complement selecting portion 60 outputs the value "b". At time $t_3$ when clock $\phi$ rises up, the waveform data $W_{a+1}$ is read from the waveform memory portion M in synchronism with clock $\phi$. As a result, the multiplier 61 outputs multiplication result $bW_{a+1}$, so that the adder 62 adds the present multiplication result $bW_{a+1}$ to the preceding multiplication result $(1-b)W_a$. Meanwhile, since the output of AND gate 66 rises up at time $t_3$ (i.e., the leading edge of clock $\phi$), the latch 65 inputs the addition result of adder 62. Thus, the input data of latch 65 corresponds to the foregoing operation result (see foregoing operation (2)). Thereafter, every time the output of AND gate 66 rises up, the latch 65 inputs the operation result as indicated by the foregoing operation (2). In the foregoing operation (2), the read-out addresses for the waveform data $W_a$, $W_{a+1}$ are sequentially renewed under the operation of the read control portion 34.

As described above, the selected two waveform data are mixed together. Then, the mixed waveform data (i.e., the synthesized musical tone waveform) outputted from the interpolation portion 36 is multiplied by an output of envelope waveform generating portion 38 in a multiplier 37 shown in FIG. 9. Due to this multiplication operation of the multiplier 37, the envelope is applied to the synthesized musical tone waveform. Herein, the envelope waveform generating portion 38 generates envelope waveform data based on the tone color data TC, key code KC and key-on signal KON, and then the envelope waveform data is supplied to the multiplier 37.

(3) Whole Operation

At first, the performer operates the tone color selector 5 to thereby designate the desirable tone color and also operates the normalized curve setting portion 20 to input the data of the significant points. When starting the performance, the normalized curve forming portion 23 forms the normalized curve based on the data of significant points inputted thereto, and then the formed normalized curve is written into the normalization table 15 under operation of the write control portion 24. Next, when the performer starts to perform the music by use of the keyboard 1, the key code KC, key-on signal kON and touch data TD corresponding to the depressed key are generated by the key-depression detecting portion 2 and initial-touch detecting portion 3. Then, the key code KC is converted into the data CDA by the normalization table 15. The multiplier 35 shown in FIG. 9 multiplies this data CDA by the value of number register 31 to thereby compute the values "a", "b". Based on the computed value "a" and touch data TD, two waveform memories are selected. Next, the read control portion 34 generates the address data for the selected two waveform memories, so that the waveform data is alternately read from each of the two waveform memories. Thereafter, the two waveform data are mixed together in accordance with the foregoing operation (2) in the interpolation portion 36. The envelope generated from the envelope waveform generating portion 38 is applied to the mixed waveform data. Thus, the output of multiplier 37 (i.e., the synthesized musical tone waveform) is supplied to the sound system 12 via the D/A converter 11 shown in FIG. 2. As a result, the sound system 12 can generate a musical tone having the synthesized musical tone waveform based on the two waveforms stored in the two waveform memories. Thereafter, a similar operation is carried out with respect to each of the depressed keys, so that the musical tones are sequentially generated. In the first embodiment, the mixing rate to be employed when mixing two waveforms stored in the selected two waveform memories is varied in response to the pitch of the depressed key. Herein, the variation of the mixing rate is determined by the normalized curve to be formed as described before.

(4) Modification

In the first embodiment, the normalized curve is formed by the normalized curve control portion 19 shown in FIG. 2. Instead, it is possible to select a desirable one of the predetermined normalized curves before performing the music.

[B] SECOND EMBODIMENT

Next, description will be given with respect to the second embodiment of the present invention. In contrast to the above-mentioned first embodiment, the second embodiment is characterized by selecting a waveform memory by using the key-striking intensity (i.e., touch data) as the parameter.

(1) Whole Configuration

The second embodiment is similar to the first embodiment in many parts but different in the following points.

Figure 15:
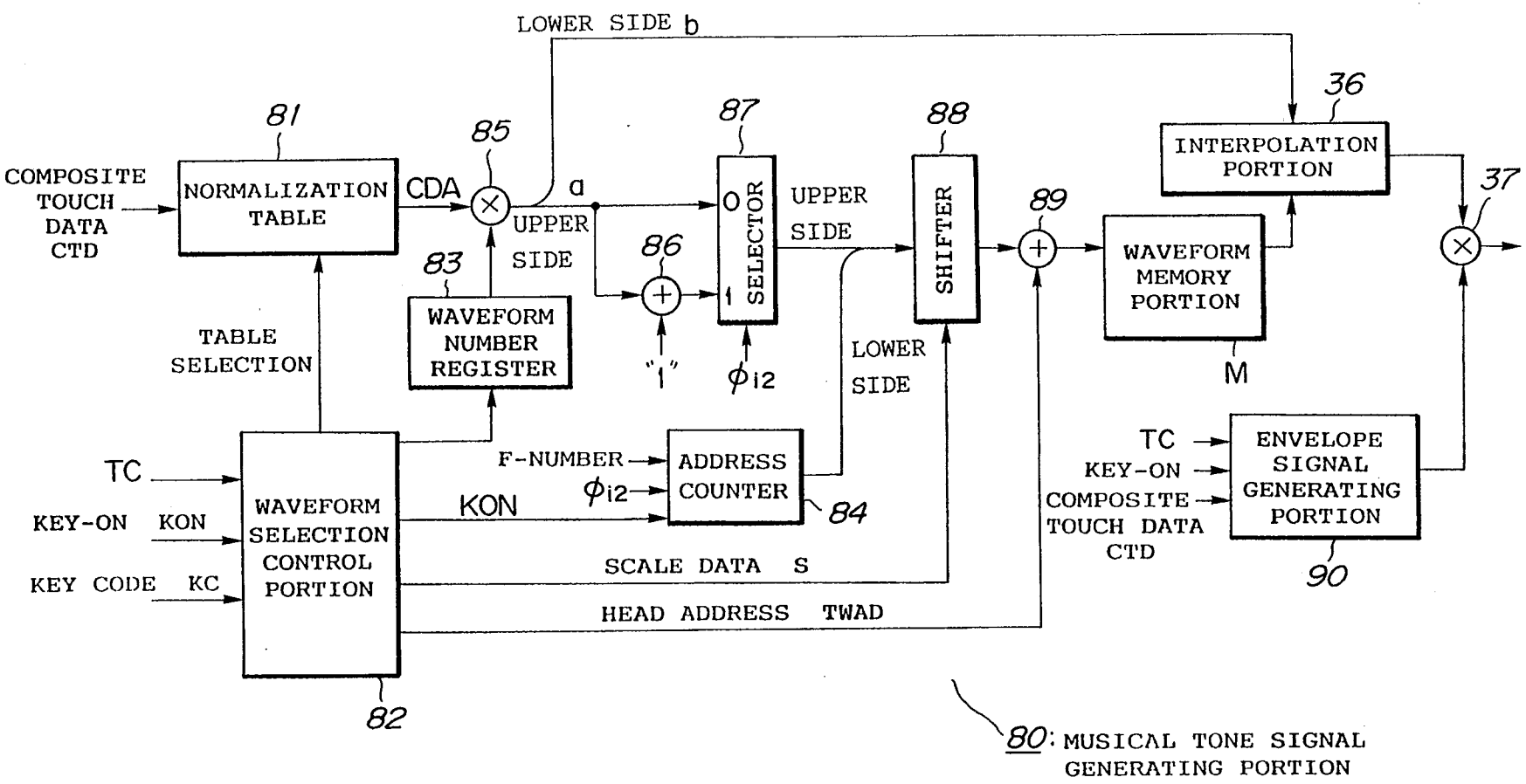
FIG. 15 is a block diagram showing a detailed configuration of a musical tone signal generating portion of the second embodiment.

(a) Instead of the musical tone signal generating portion 10 shown in FIG. 2, another musical tone signal generating portion 80 as shown in FIG. 15 is provided in the second embodiment.

Figure 14:
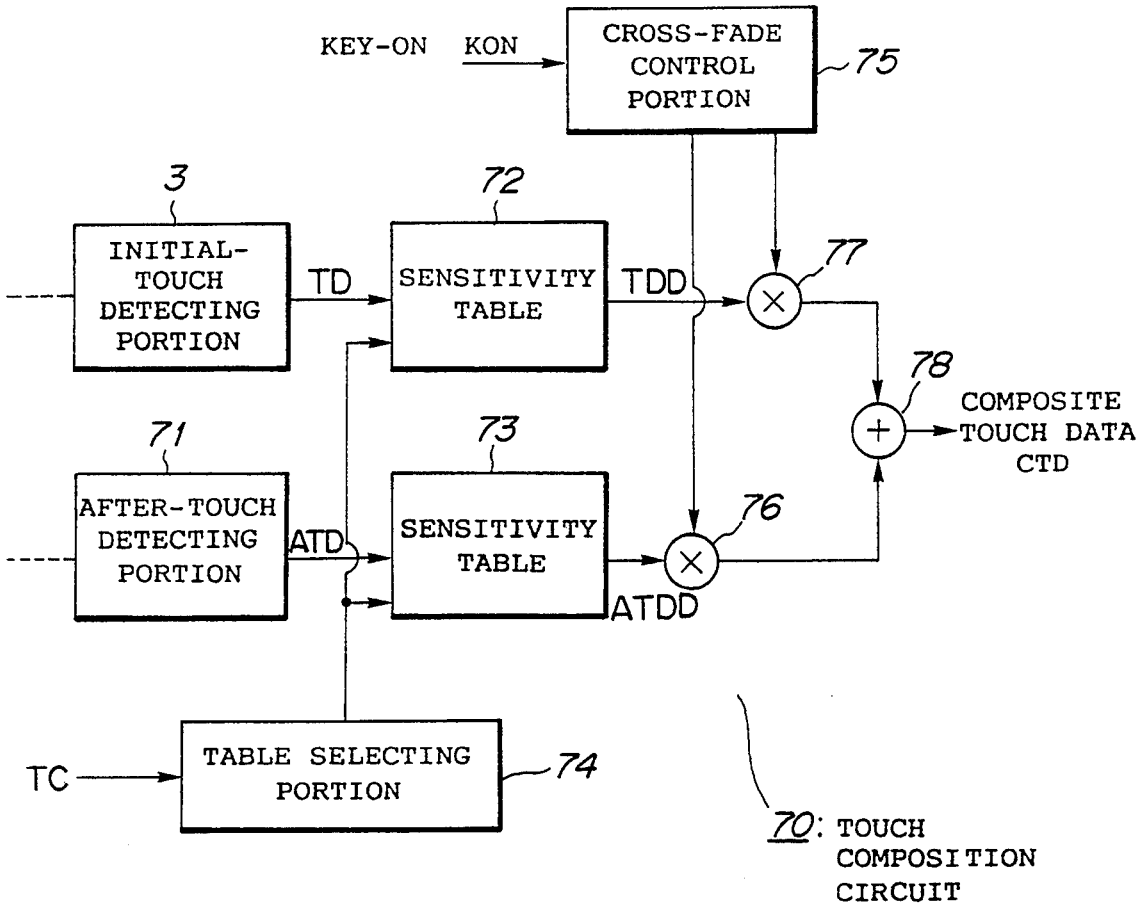
FIG. 14 is a block diagram showing a detailed configuration of a touch composition circuit of the second embodiment.

(b) A touch composition circuit 70 as shown in FIG. 14 is further provided between the initial-touch detecting portion 3 and the musical tone signal generating portion 80.

(c) The waveform data stored in the waveform memory indicates the waveform including the loop portion of only one period. In the case of the same tone color and same key-striking intensity (i.e., same touch intensity), the same memory scale is employed for the waveform memory.

(2) Configuration and Operation of Each Circuit Portion

Next, description will be given with respect to the detailed configuration and operation of each circuit portion of the second embodiment.

(a) Touch Composition Circuit 70

In the touch composition circuit 70 shown in FIG. 14, 71 designates an after-touch detecting portion which detects the after-touch applied to the key to thereby generate after-touch data ATD. On the other hand, the initial-touch detecting portion 3 generates the initial-touch data TD. In addition, 72, 73 designate sensitivity tables each pre-storing plural sensitivity curves corresponding to the tone colors. Each sensitivity curve is selected by a table selecting portion 74 which operates based on the tone color designating signal TC. The sensitivity tables 72, 73 convert the touch data TD, ATD into TDD, ATDD respectively in response to the selected sensitivity curve. The reason why the sensitivity tables 72, 73 are provided is that the touch sensitivity characteristic is different with respect to each kind of the musical instrument (such as the piano, organ etc.). These converted touch data TDD, ATDD are multiplied by an output of the cross-fade control portion 75 in multipliers 77, 76 respectively. Then, the multiplication results of the multipliers 76, 77 are added together in an adder 78. The addition result of adder 78 is output as composite touch data CTD.

Figure 16:
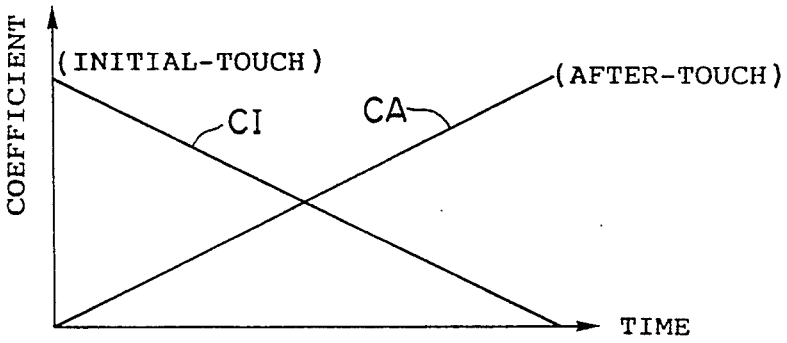
FIG. 16 shows a control characteristic of a cross-fade control portion shown in FIG. 14.

The cross-fade control portion 75 outputs respective coefficients CI, CA shown in FIG. 16 to the multipliers 77, 76. More specifically, the coefficient CI supplied to the multiplier 77 is linearly attenuated with an elapsed time, while the coefficient CA supplied to the multiplier 76 is linearly increased with an elapsed time. As a result, the composite touch data CTD is mainly affected by the initial-touch in the initial period, and then CTD is gradually affected by the after-touch with an elapsed time.

(b) Musical Tone Signal Generating Portion 80

In the musical tone signal generating portion 80 shown in FIG. 15, 81 designates a normalization table which pre-stores plural normalization curves with respect to the tone colors. When the tone color designating signal TC is supplied to a waveform selection control portion 82, the waveform selection control portion 82 subtracts "1" from the number of the waveform memories corresponding to the designated tone color (see FIG. 18), and then its subtraction result is written into a waveform number register 83. In addition, the waveform selection control portion 82 directly transmits the key-on signal KON supplied thereto to an address counter 84. Herein, the waveform selection control portion 82 is designed to output the waveform head address, scale data S and normalized curve selecting data based on address information stored in an inner memory provided therein.

Figure 17:
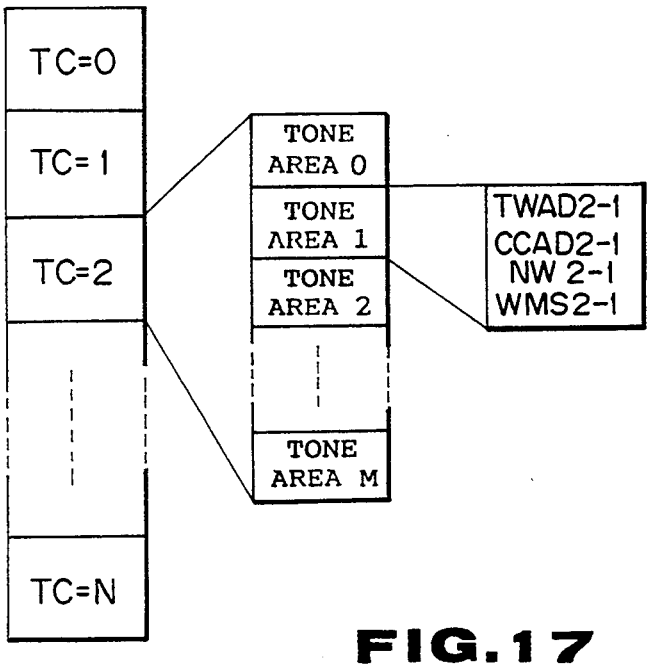
FIG. 17 shows a data format of data stored in a waveform selection control portion shown in FIG. 15.

Next, description will be given with respect to the process of outputting the above-mentioned data from the waveform selection control portion 82 by referring to FIG. 17 which shows the address information stored in the inner memory. If the tone color 2 (i.e., TC=2) is selected and the tone area 1 is also selected based on the key code KC, the address information is selected in response to the tone color 2 and tone area 1 as shown in FIG. 17. This address information includes waveform head address data TWAD, normalized curve selecting data CCAD, waveform memory number data NW and scale data S. In "2-1" shown in FIG. 17, "2" indicates the tone color number and "1" indicates the tone area number.

Figure 18:
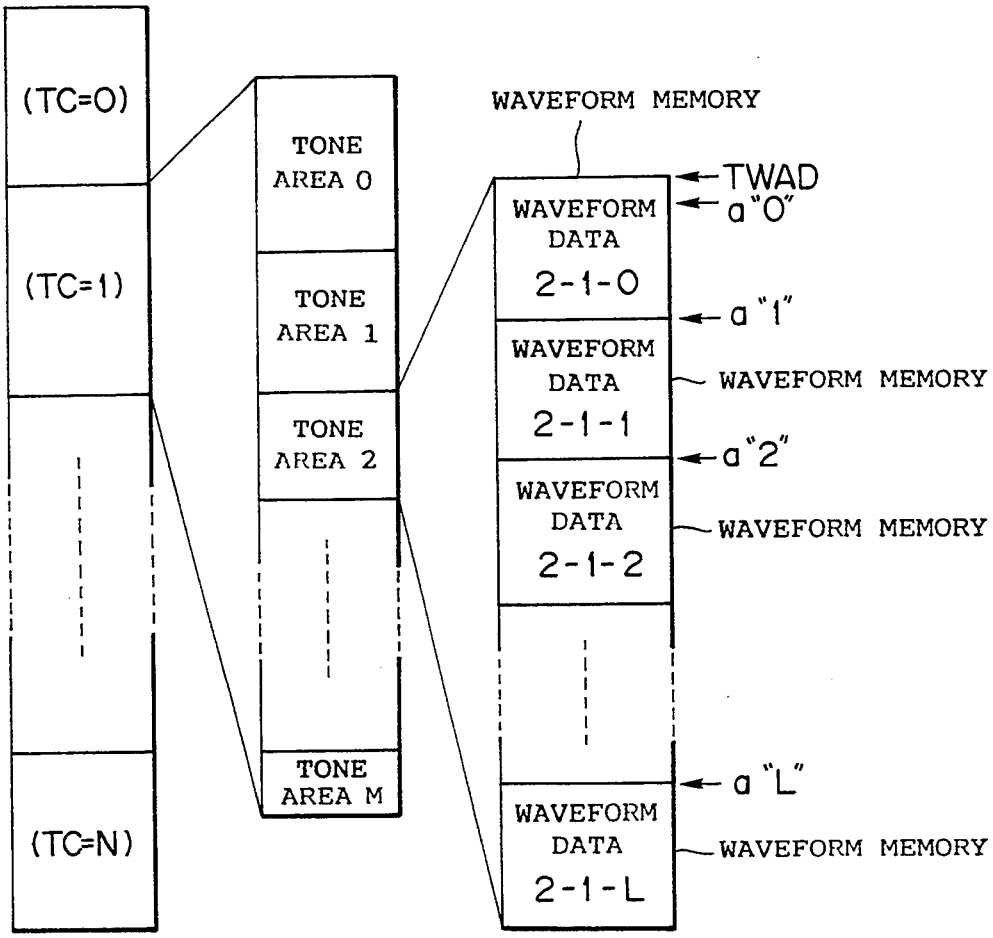
FIG. 18 is a drawing showing a waveform selecting operation of the waveform selection control portion shown in FIG. 15.

FIG. 18 is the memory map of the waveform memory portion M according to the second embodiment. As shown in FIG. 18, the address number is increased in response to the tone color number which ranges from "0" to "N". In addition, each tone color area provides memory areas corresponding to the tone area number which ranges from "0" to "M". Further, the address number is increased as the tone area number is increased. Furthermore, each memory area corresponding to each tone area includes plural waveform memories of which number corresponds the composite touch data CTD. As described before, each waveform memory stores the waveform data of one period. Incidentally, in the character like "2-1-0" in FIG. 18, "2" indicates the tone color number, "1" indicates the tone area number and "0" indicates the waveform data corresponding to the touch data which is at "0". The other characters "2-1-1" etc. have similar meanings. For example, the head address data TWAD indicates the head address number of the memory area corresponding the tone area number 2, i.e., the head address of the waveform memory which stores the waveform data indicated by the character (2-1-0). Such head address data TWAD is supplied to an adder 89 shown in FIG. 15.

Next, the normalized curve selecting data CCAD is supplied to the normalization table 81 wherein a desirable normalized curve is selected in response to this data CCAD. In addition, the scale data S is supplied to a shifter 88 as its shift signal.

In FIG. 15, a multiplier 85 multiplies the output CDA of normalization table 81 by the value stored in the waveform number register 83, so that the multiplication result thereof corresponds to the foregoing operation (1). Herein, "a", "b" respectively designate the upper side and lower side of the multiplication result of multiplier 85. Next, 86 designates an adder which adds "1" to "a", and 87 designates a selector in which "a" is supplied to 0-bit input terminal and (a+1) outputted from adder 86 is supplied to 1-bit input terminal. In this selector 87, 0-bit input terminal is selected when clock $\phi_{i2}$ is at "0" but 1-bit input terminal is selected when clock $\phi_{i2}$ is at "1". Then, the output of selector 87 is supplied to the upper side of the shifter 88, while the output of address counter 84 is supplied to lower side of the shifter 88. The adder 89 adds the head address data TWAD and the output of shifter 88 together. Thereafter, the addition result of adder 89 is supplied to the waveform memory portion M as its address data. Herein, the address counter 84 carries out the count operation similar to the foregoing address counter 40 shown in FIG. 11.

Next, description will be given with respect to the address data output from the adder 89. For convenience' sake, the head address data TWAD designates the head address of the waveform memory which stores the waveform data (2-1-0), and the operation of shifter 88 can be omitted. Since "a" is used as the upper-bit-data in the shifter 88, the upper side of the address data is determined by "a". In the second embodiment, every time "a" is incremented as "0", "1", "2", . . . , the address data indicates the head address of the waveform memory which stores the waveform data (2-1-0), (2-1-1), (2-1-2), . . . (see FIG. 18). Since the output of address counter 84 is used as the lower side of the address data, the waveform data is read from the waveform memory designated by "a" in response to the increment of the count operation of the address counter 84. Due to the operation of the selector 87, the values "a", (a+1) are alternately selected as the upper side of the address data by every half period of clock $\phi_{i1}$ so that the waveform data are alternately read from the neighboring two waveform memories. In other words, as similar to the foregoing first embodiment, the waveform data $W_a$, $W_{a+1}$ are alternately read out in the second embodiment. In the case where the waveform data are alternately read from two waveform memories which store the waveform data (2-1-1), (2-1-2) respectively, the read-out operation is performed as follows: the waveform data is read from address 0 of the waveform memory (2-1-1) at first; then waveform data is read from address 0 of the waveform memory (2-1-2); waveform data is read from address 1 of the waveform memory (2-1-1); and then waveform data is read from address 1 of the waveform memory (2-1-2).

Figure 19:
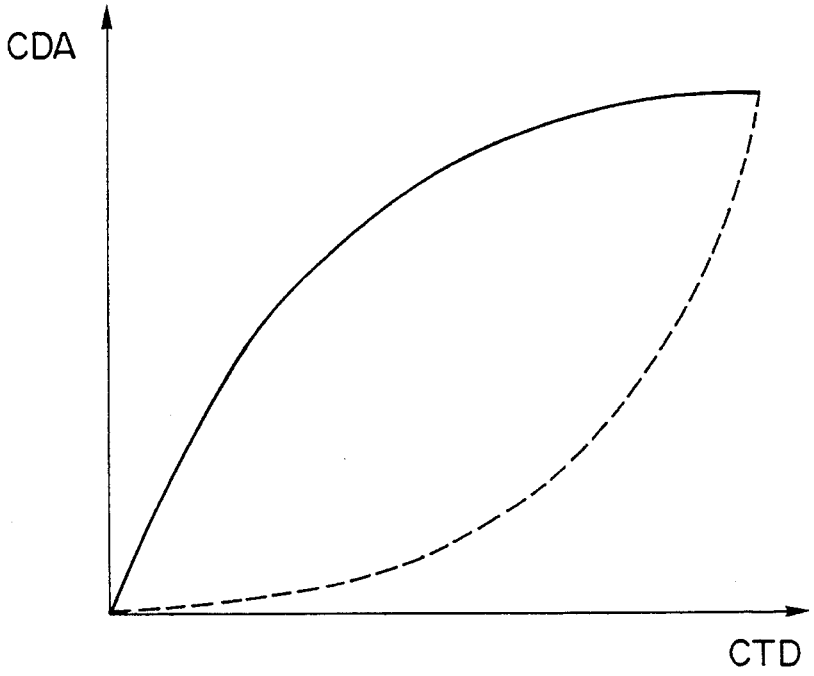
FIG. 19 shows an example of normalized curve data.

As described above, since the waveform memory is directly selected by "a", the waveform memory density (representing the number of waveform memories) to be assigned to each key-striking intensity (i.e., initial-touch and after-touch) is determined by the normalized curve set in the normalization table 81. Therefore, in order to obtain the waveform variety in the area where the key-striking intensity is relatively small (which occurs when the music is performed softly in piano or pianissimo etc.), the waveform memory density is set higher in such area. For example, the normalized curve is set as shown by the solid line in FIG. 19. In contrast, in order to obtain the tone color variation in the area where the key-striking intensity is relatively high (which occurs when the music is performed loudly in forte or fortissimo etc.), the normalized curve is set as shown by the dotted line in FIG. 19.

Next, the waveform data $W_a$, $W_{a+1}$ read from the waveform memory portion M are supplied to the interpolation portion 36 shown in FIG. 15. As described before, the interpolation portion 36 carries out the foregoing operation (2) to thereby mix these waveforms together. Then, the multiplier 37 multiplies the mixed waveform data by an envelope signal output from an envelope signal generating portion 90. Thereafter, the multiplication result of multiplier 37 (i.e., the synthesized musical tone waveform) is supplied to the D/A converter 11 shown in FIG. 2. In contrast to the foregoing envelope signal generating portion 38 shown in FIG. 9, the envelope signal generating portion 90 generates the envelope signal based on the composite touch data CTD, key-on signal KON and tone color designating signal TC.

(3) Whole Operation

When the performer depresses the key, the initial-touch and after-touch of the depressed key are detected and then mixed together by the touch composition circuit 70 so that the composite touch data CTD is generated. This composite touch data CTD is converted into the data CDA in the normalization table 81, and this data CDA is multiplied by the value of waveform number register 83 in the multiplier 85 so that a multiplication result consisting of the values "a", "b" is obtained. Based on these values "a", "b", the selection of the waveform memory and waveform data mixing ratio are controlled. In this case, under operation of the cross-fade control portion 75, the value of the composite touch data CTD varies with an elapsed time in accordance with the characteristic depending on the initial-touch and after-touch to be detected. Thus, a variation of the data CDA introduces variation of the values "a", "b", by which the selected waveform memory and waveform data mixing ratio are to be varied with an elapsed time. In other words, the waveform data is smoothly selected with an elapsed time in response to the initial-touch and after-touch intensities. Herein, the normalized curve itself is not changed, and consequently it is possible to vary the waveform data in response to the preset characteristic.

(4) Modification

Figure 20:
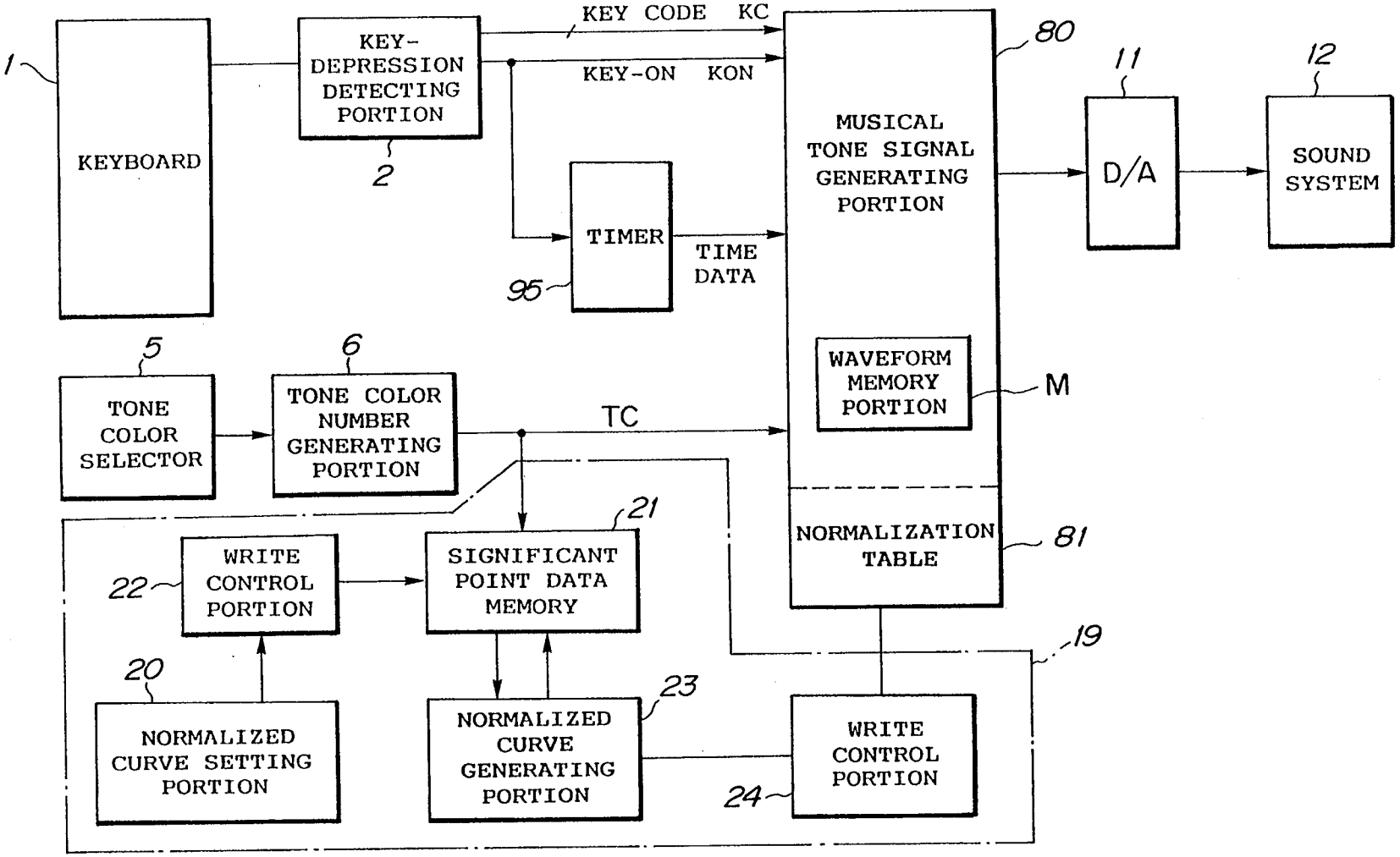
FIG. 20 is a block diagram showing a modified example of the second embodiment.

In the above-mentioned second embodiment, the normalization table 81 pre-stores plural normalized curves. Instead, it is possible to provide the normalized curve control portion 19 as shown in FIG. 20 by which the performer can set the desirable normalized curve. Instead of the touch composition circuit 70, it is possible to provide a timer 95. This timer 95 generates time data which varies with an elapsed time after the key-on signal KON is output from the key-depression detecting circuit 2. In this case, this time data is used instead of the foregoing composite touch data CTD. As the output characteristic of this timer 95, it is possible to set an arbitrary characteristic, e.g., a characteristic which remarkably varies in the attack portion or a characteristic which remarkably varies in the sustain portion.

Incidentally, when using the timer 95, detection of the initial-touch and after-touch can be omitted so that the circuit configuration can be simplified in this modification as shown in FIG. 20.

[C] THIRD EMBODIMENT

Next, description will be given with respect to the third embodiment of the present invention by referring to FIGS. 21, 22, wherein parts identical to those shown in FIG. 15 will be designated by the same numerals, hence, description thereof will be omitted.

(1) Whole Configuration

Figure 21:
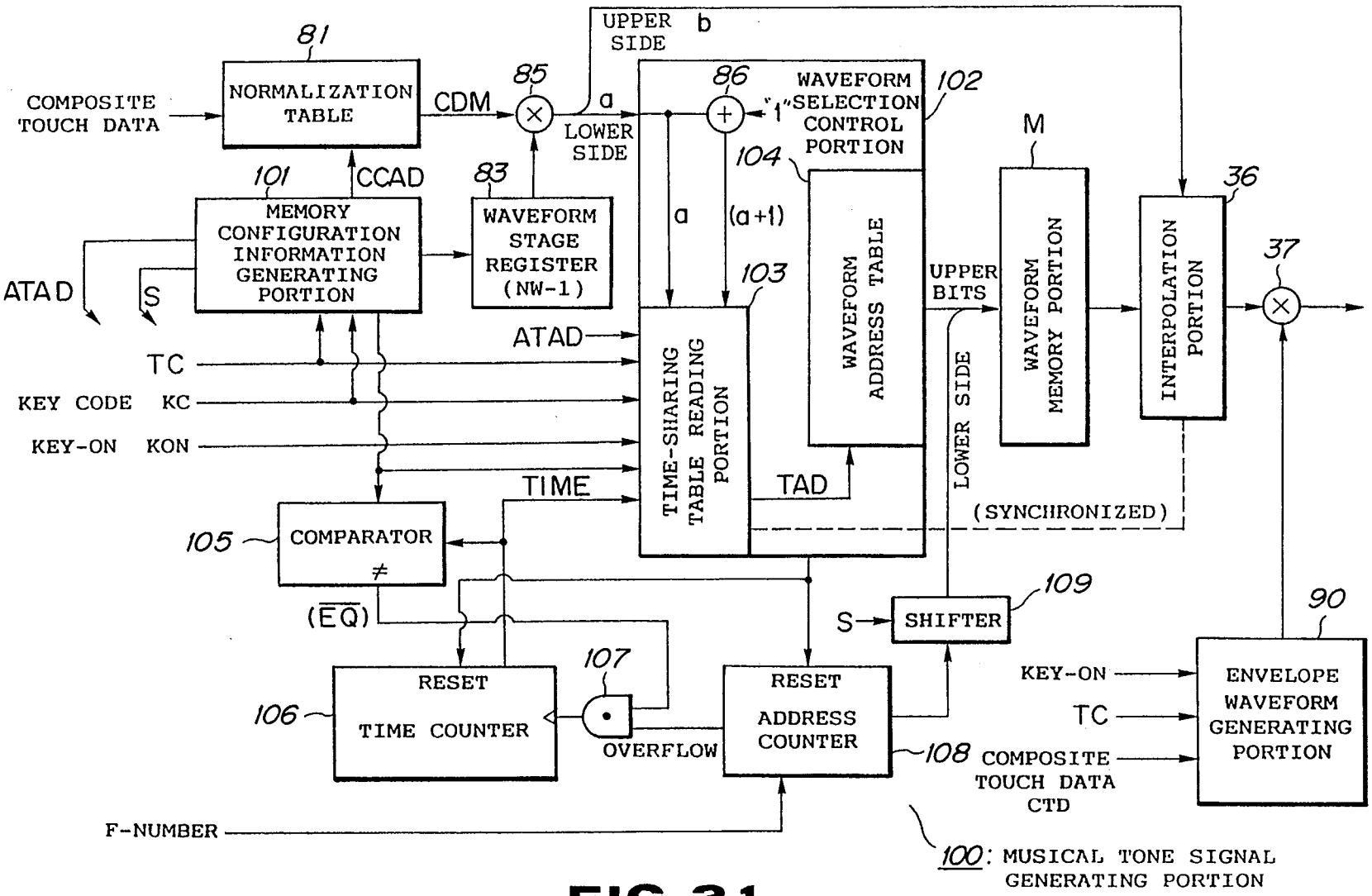
FIG. 21 is a block diagram showing a detailed configuration of a musical tone signal generating portion according to a third embodiment.

The whole configuration of the electronic musical instrument to which the third embodiment is applied is as shown in FIG. 2, and the third embodiment is characterized by using a musical tone signal generating portion 100 shown in FIG. 21 instead of the musical tone signal generating portion 80 shown in FIG. 15 as compared to the foregoing second embodiment. Herein, the waveform data stored in the waveform memory indicates the waveform including the attack portion and loop portion as shown in FIG. 4.

(2) Configuration and Operation of Each Circuit Portion

In FIG. 21, 101 designates a memory configuration information generating portion which generates several kinds of signals based on the tone color designating signal TC and key code KC. Hereinafter, description will be given with respect to the operation of this memory configuration information generating portion 101.

Figure 22:
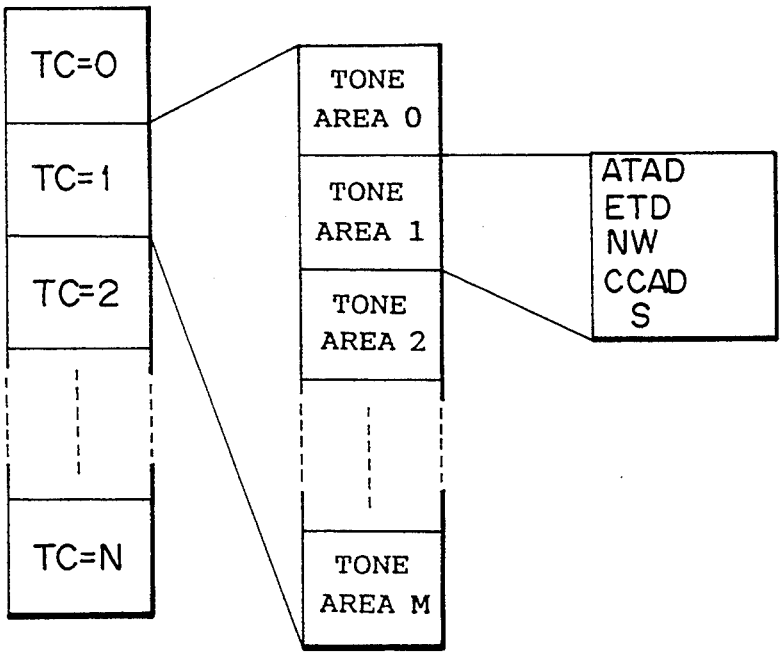
FIG. 22 is a drawing showing an operation of a memory configuration information generating portion shown in FIG. 21.

FIG. 22 shows the format of the data which is stored in the memory configuration information generating portion 101. When the tone color designating signal TC is at "1", the memory area corresponding to TC=1 is designated. Then, based on the key code KC, the desirable tone area is designated. When tone area 1 is designated, the address information stored therein is read out. This address information includes head address data ATAD, end time data EDT, variation curve selecting data CCAD, waveform memory number data NW and scale data S. Herein, the end time data EDT indicates the end portion of the attack portion, thus indicating the frequency of the attack portion. Other data within the address information of the third embodiment is similar to those of the second embodiment. In addition, the address information is also stored with respect to other tone areas and other tone colors. As described above, the desirable address information is read out in response to the tone color designating signal TC and key code KC.

Next, a waveform selection control portion 102 shown in FIG. 21 having a time-sharing table reading portion 103 and a waveform address table 104 generates the address data to be supplied to the waveform memory portion M. Herein, the waveform address table 104 converts table address TAD into an upper side of a physical address in the waveform memory portion M. The time-sharing table reading portion 103 generates the table address TAD by which the waveform data $W_a$, $W_{a+1}$ are alternately read from the waveform memory portion M. In the addition, an address counter 108 generates a lower side of address data of the waveform memory portion M. The output of this address counter 108 is supplied to the waveform memory portion M via a shifter 109. The address counter 108 and shifter 109 have functions similar to those of the foregoing address counter and shifter of the foregoing embodiments. Every time the address counter 108 overflows, the address counter 108 outputs the carry signal to an AND gate 107. The output of this AND gate 107 is supplied to a time counter 106 as a clock signal. The output of time counter 106 is supplied to the time-sharing table reading portion 103 and a comparator 105 as time data TIME. Based on this time data TIME, the time-sharing table reading portion 103 detects the end timing of the attack portion. When the time data TIME coincides with the end time data ETD, the comparator 105 outputs the "0" signal to the AND gate 107 so that the AND gate 107 is set in the closed state. While these data TIME, ETD do not coincide with each other, the comparator 105 outputs the "1" signal such that the AND gate 107 is set in the open state. Incidentally, both of the time counter 106 and address counter 108 can be reset by the reset signal supplied from the waveform selection control portion 102.

Figure 23:
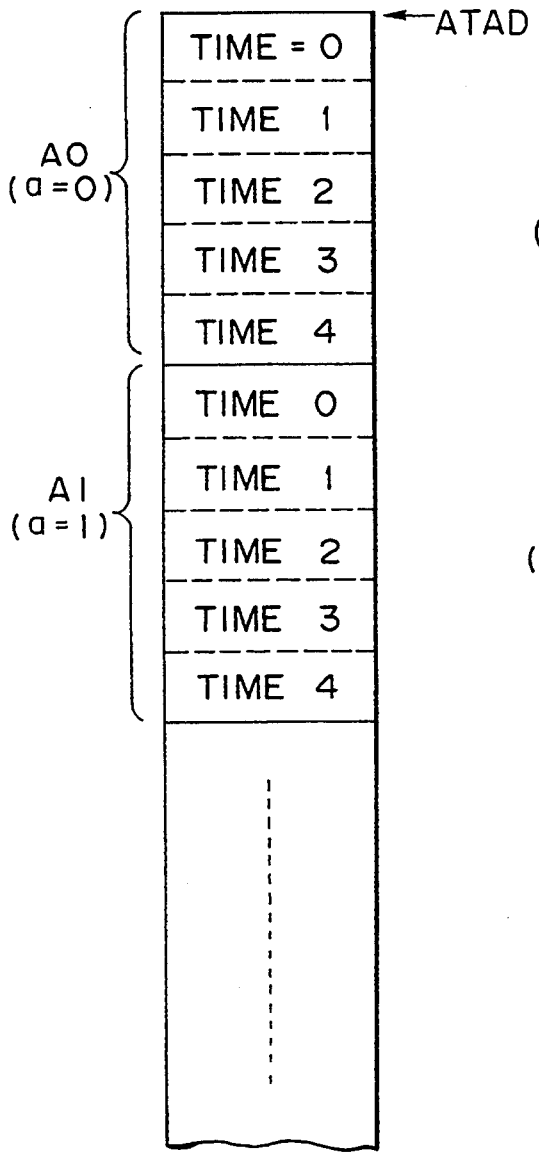
FIG. 23 is a memory map of the waveform memory according to the third embodiment.

Next, description will be given with respect to the time-sharing table reading portion 103 which generates the table address TAD. FIG. 23 shows the memory map in the upper side address of the waveform memory portion M. Actually, FIG. 23 shows the memory map of the memory area corresponding to the combination of the tone color designating signal TC and tone area (e.g., tone color 1 and tone area 1).

As shown in FIG. 23, the memory area is divided into small areas A0, A1, . . . each corresponding to the value "a" (i.e., a=0, a=1, . . . ) and each storing a series of waveform data. Further, each of areas A0, A1, . . . is divided into several sections corresponding to the time data TIME. In the area A0, the sections corresponding to the time data TIME0 to TIME3 correspond to the attack portion, so that each section stores the attack portion of one period such that these sections store the attack-portion waveforms continuously. In addition, the loop portion is stored in the section corresponding to the time data TIME4.

Similarly, in the area A1, the sections corresponding to the time data TIME0 to TIME3 correspond to the attack portion, and the section corresponding to the time data TIME4 corresponds to the loop portion. As described above, the waveform length of the attack portion is same in each of the areas A0, A1, . . . However, if the tone color or tone area is different, the waveform length of the attack portion can be different.

Next, the time-sharing table reading portion 103 generates the table address TAD based on the following operation (3).

$$TAD = ATAD + a^*(ETD+1) + \mathrm{TIME} \quad (3)$$

Herein, the end time data ETD indicates the frequency of the attack portion, while the data ATAD indicates the head address of the waveform data to be selected. Therefore, the operation result of "ATAD+a*-(ETD+1)" indicates the head address of the area $A_a$ (where a=0, 1, . . . ). Thus, the operation result of the above-mentioned formula (3) indicates the address of area $A_a$ which corresponds to the time data TIME. As shown in FIG. 21, the time-sharing table reading portion 103 inputs the values a, (a+1). Thus, the time-sharing table reading portion 103 will carry out the operation (3) by alternate use of these values a, (a+1). In the case of a=0, the address is computed with respect to the section "TIME=0" in the area A0 at first, and then another address is computed with respect to the section "TIME=0" in the area A1. Next, the address is computed with respect to the section "TIME=1" in the area A0, and then another address is computed with respect to the section "TIME=1" in the area A1. Similarly, other addresses are sequentially computed with alternate respect to the other sections in the two areas A0, A1. Herein, the computed address is used as the table address TAD. The computation period of the operation (3) which is alternately performed with respect to two areas A0, A1 is set identical to a half of the waveform data reading period.

Next, detailed description will be given with respect to the operation of generating the table address TAD.

First, the time-sharing table reading portion 103 shown in FIG. 21 outputs the reset signal to thereby reset the time counter 106 and address counter 108. Then, this time-sharing table reading portion 103 carries out the foregoing operation (3) by use of the head address data ATAD, end time data ETD and the value "a" which is supplied from the multiplier 85. As a result, the table address data TAD indicating the head address of area $A_a$ is supplied to the waveform address table 104. Thus, the upper side of the address data is read from the waveform address table 104 in response to the table address data TAD, and then the upper side of the address data is supplied to the waveform memory portion M. In this case, the upper side of the address data has the bit number and bit position corresponding to the memory scale of the waveform memory to be selected.

Meanwhile, the address counter 108 counts the F-number, and then the count value thereof is supplied to the waveform memory portion M via the shifter 109 as the lower side of the address data. At this time, the shifter 109 carries out the shift operation in accordance with the scale data S. As a result, the upper side and lower side of the address data have the respective bit numbers corresponding to the memory scale of the waveform memory to be selected. Thus, based on the above-mentioned upper side and lower side of the address data, the waveform data $W_a$ is read from the head address of the section "TIME=0" in the area $A_a$ and then supplied to the interpolation portion 36. The above-mentioned operation is carried out with respect to the value "a".

Next, the time-sharing table reading portion 103 carries out the operation (3) by use of the value (a+1) supplied from an adder 86, so that the head address of area $A_{a+1}$ is supplied to the waveform address table 104 as the table address data TAD. As a result, the waveform address table 104 generates the upper side of the address data corresponding to the area $A_{a+1}$, and then the upper side of the address data is supplied to the waveform memory portion M. At this time, the address counter 108 has not counted the next value, hence, the lower side of the address data has not been varied yet. Therefore, the data stored at the head address of the section "TIME=0" in the area $A_{a+1}$ is output to the interpolation portion 36 as the waveform data $W_{a+1}$.

When the address counter 108 counts the next F-number, the lower side of address data is renewed. Based on the renewed lower side of address data, the above-mentioned operation is carried out so as to generate the upper side of address data. Thus, the waveform data $W_a$, $W_{a+1}$ are alternately output. In this case, the table address data TAD to be generated by the operation (3) is not changed, hence, the upper side of the address data remains the same.

Thereafter, every time the address counter 108 increments its count value, the lower side of the address data is renewed. When the address counter 108 overflows, the carry signal is supplied to the time counter 106 via the AND gate 107 so that the count value of time counter 106, i.e., the time data TIME is changed from "0" to "1". Every time the time data TIME is incremented by "1", the table address data TAD (i.e., result of the foregoing operation (3)) is incremented by "1" in both of the areas $A_a$, $A_{a+1}$. As a result, the upper side of the address data to be output from the waveform address table 104 is incremented by "1". With respect to the incremented upper side of the address data, the lower side of the address data is renewed based on the count value of the address counter 108. Thus, the waveform data are alternately read from the sections "TIME=1" in the areas $A_a$, $A_{a+1}$, wherein each of the read waveform data corresponds to the second section of the waveform data. These waveform data are supplied to the interpolation portion 36 as the waveform data $W_a$, $W_{a+1}$. Thereafter, every time the address counter 108 overflows, the time data TIME is incremented, hence, the waveform data of several periods in the attack portion (see FIG. 4) are sequentially read out.

When the time data TIME becomes equal to the end time data ETD, the comparator 105 shown in FIG. 21 outputs the "0" signal. Due to this "0" signal, the AND gate 107 is set in the closed state. Thereafter, if the address counter 108 overflows, the time counter 106 does not count up any more. Therefore, the table address data TAD is not varied from that time.

In the case of FIG. 23, the end time data EDT is set at "4". Therefore, when the time data TIME is at "4" (i.e., TIME=4), the table address data TAD is fixed. Such fixed table address indicates the upper address of the loop portion of the waveform. Once the loop portion is read out, the upper side of the address data is fixed, and thereafter, the waveform data at the loop portion is repeatedly read out in accordance with the count value of address counter 108.

Next, the waveform data $W_a$, $W_{a+1}$ read from the waveform memory portion M as described above are mixed together in the interpolation portion 36. Further, the multiplier 37 applies the desirable envelope to the mixed waveform data to be output from the interpolation portion 36. This operation is similar to that of the foregoing second embodiment.

(3) Whole Operation

The whole operation of the third embodiment is similar to that of the foregoing second embodiment. Therefore, the waveform memory corresponding to the key-striking intensity is selected in accordance with the normalized curve. Herein, when the coincidence is detected between the end time data ETD and time data TIME, it is Judged that the read waveform data enters into the loop portion of the waveform, and thereafter, the waveform data of the loop portion is repeatedly read out. For this reason, even if plural waveform data each having the different waveform lengths of the loop portion are simultaneously used, it is possible to synthesize the musical tone signal without any problem.

(4) Modification

Figure 24:
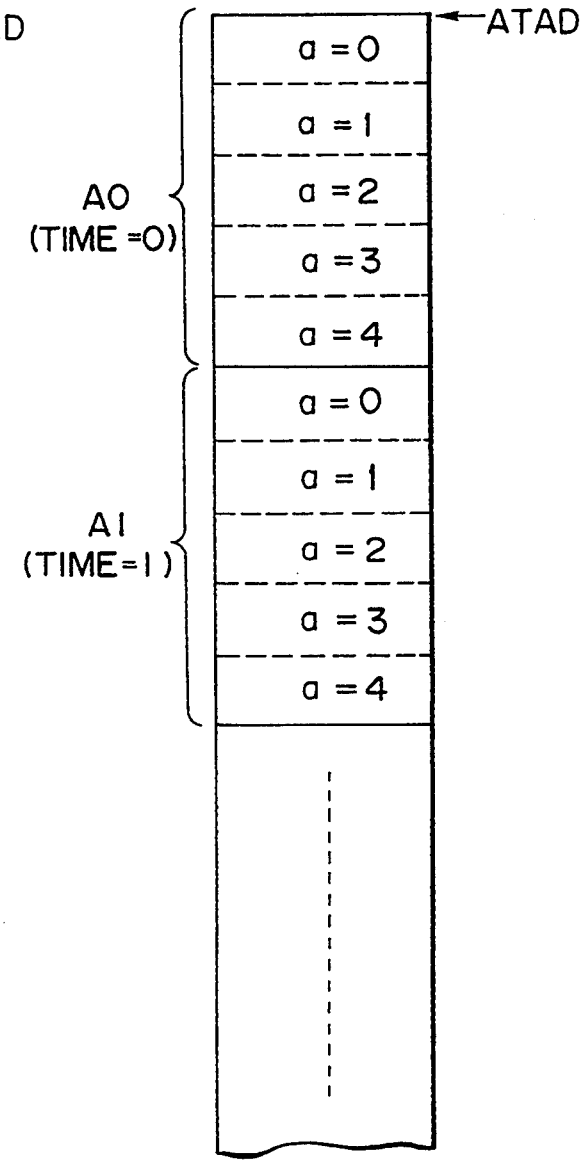
FIG. 24 is a memory map of the waveform memory according to a modified example of the third embodiment.

Instead of the memory as shown in FIG. 23, it is possible to use another memory as shown in FIG. 24 which indicates the memory area corresponding to the upper side of the address data wherein the waveform data is stored in response to the combination of the tone color designating signal TC and tone area. In addition, FIG. 24 indicates the case where the five waveform memories are provided in one memory block.

In case of FIG. 24, the memory area is divided into several areas A0, A1, . . . each storing each of first section, second section, . . . of the waveform data. In addition, these areas A0, A1 . . . respectively correspond to TIME=0, TIME=1, . . . Further, each area is divided into five sections each corresponding to the value "a" which ranges from "0" to "4". If there are provided areas A0 to $A_M$, the areas A0 to $A_{M-1}$ correspond to the attack portion, while the remained area $A_M$ corresponds to the loop portion.

In the case where the memory map as shown in FIG. 24 is employed, the table address data TAD is computed in accordance with the following operation (4).

$$TAD=ATAD+TIME*NW+a \quad (4)$$

Herein, NW indicates the waveform number data, while ATAD indicates the head address of the waveform data to be selected. Therefore, the addition result of "ATAD+TIME*NW" indicates the head address of area $A_{TIME}$ (where TIME=0, 1, . . . ). Thus, the result of operation (4) indicates the address corresponding to the value "a" in the area $A_{TIME}$. The time-sharing table alternate reading portion 103 carries out the operation (4) with respect to the values a, (a+1). For example, in case of TIME=0 & a=0, the address of section a=0 in the area A0 is computed and then another address of section a=1 in the area A0 is computed in FIG. 24. Next, after the time data TIME is incremented, the addresses of sections a=0, a=1 in the area A1 are sequentially computed. Similarly thereafter, every time the time data TIME is renewed, the addresses of sections a=0, a=1 are computed with respect to the new area. The period of the above-mentioned computation is set equal to a half of the waveform data reading period. In this case, when the time data TIME becomes equal to the end time data ETD (i.e., TIME=ETD), the waveform at the loop portion is repeatedly read out.

In the third embodiment, plural normalization tables are preset in the normalization table 81. Instead, it is possible to further provide the normalized curve control portion 19 as shown in FIG. 2 by which the normalization table can be rewritten.

[D] MODIFICATIONS

Figure 25A:
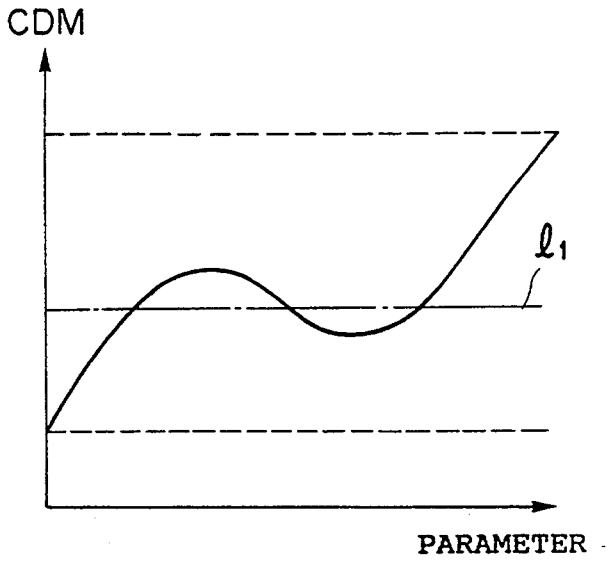
FIGS. 25A, 25B show characteristics of normalized curves data which can be applied to the embodiments.
Figure 25B:
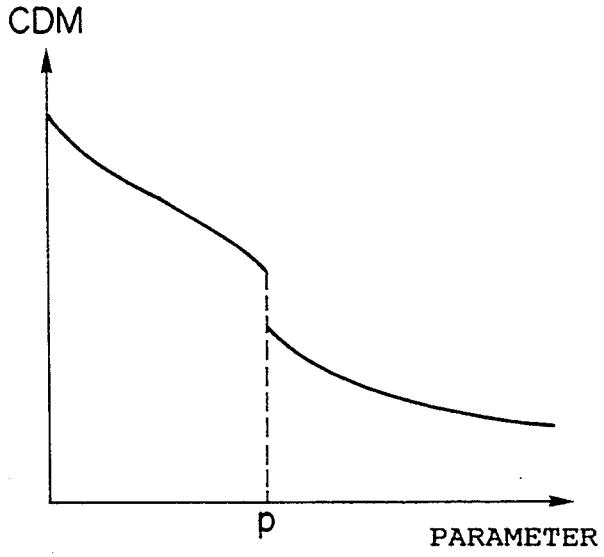

In the embodiments, it is possible to use curves as shown in FIGS. 25A, 25B instead of the normalized curve.

In FIGS. 25A, 25B, the horizontal axis represents the parameter such as the key code KC, touch data TD, data CTD etc., while the vertical axis represents the level of the normalized data CDM.

The normalized curve as shown in FIG. 25A does not correspond to the data CDM whose value is in the vicinity of its upper limit or lower limit. Therefore, the waveform memories assigned with these limit values are not used. In other words, it is possible to set the un-used area of the normalized curve by adequately setting the normalized curve. In the normalized curve as shown in FIG. 25A, the different parameters may correspond to the same value of the data CDM (see line $1_1$). Such normalized curve is available when setting the same waveform data at the predetermined parameters each corresponding to the different pitch and different key-striking intensity.

On the other hand, the normalized curve as shown in FIG. 25B has the discontinuity point at the parameter "p". As a result, the variation of the normalized curve becomes remarkable at the parameter "p". Such normalized curve is available when varying the musical tone at a certain parameter.

In the embodiments, the waveform data is stored in the waveform memory. However, the present embodiments can be modified such that the musical tone parameter (corresponding to Frequency-Modulated musical tone) or the parameter of higher harmonic wave mixing filter is stored in the memory.

As described heretofore, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A waveform synthesizing apparatus which generates a synthesized musical tone waveform in response to a key-on signal comprising:

(a) storing means for storing musical tone data, including a plurality of memory groups, M in number, each including a plurality of memories, N in number, where M, N are integers and N may vary between different groups, each of said memories storing one or more sets of musical tone data;

(b) first selecting means for selecting one of said memory groups;

(c) musical parameter inputting means for inputting a musical parameter which varies over time after said key-on signal is supplied;

(d) conversion means for converting said musical parameter in accordance with a predetermined conversion characteristic to thereby generate selection data, wherein the value of generated selection data is in a predetermined range;

(e) multiplication means for multiplying said selection data by a number which represents the number N of memories belonging to said memory group selected by said first selecting means, and outputting the result having an integer part and a decimal part;

(f) second selecting means for selecting two of said memories from said N memories contained within said memory group selected by said first selecting means in accordance with said integer part of said result, wherein the portion of said range corresponding to one of said N memories is variable in accordance with said result and wherein the assignment density of different waveform data is variable over said range; and (g) combining means for combining the two sets of musical tone data read from the two memories selected by said second selecting means in accordance with said decimal part of said result;

whereby a synthesized musical tone waveform is obtained from said combining means.

2. A waveform synthesizing apparatus according to claim 1 wherein said musical parameter is a key code obtained from a keyboard of an electronic musical instrument.

3. A waveform synthesizing apparatus according to claim 1 wherein said musical parameter is touch data corresponding to a key-striking intensity applied to each key.

4. A waveform synthesizing apparatus according to claim 1 wherein said musical parameter is time data indicative of an elapsed time which passes from a timing when each key is depressed.

5. A waveform synthesizing apparatus which generates a synthesized musical tone waveform in response to a key-on signal comprising:

(a) storing means for storing musical tone data, including a plurality of memory groups, M in number, each including a plurality of memories, N in number where M, N are integers and N may vary between different groups, each of said memories storing one or more sets of musical tone data;

(b) first selecting means for selecting one of said memory groups;

(c) generating means for generating a conversion curve;

(d) conversion means for converting a musical parameter which varies over time after said key-on signal is supplied in accordance with said conversion curve to thereby generate selection data, wherein the value of generated selection data is in a predetermined range;

(e) second selecting means for selecting two of said memories contained within a selected memory group selected by said first selecting means in accordance with said selection data, wherein the portion of said range corresponding to one of said N memories is variable in accordance with said result and wherein the assignment density of different waveform data is variable over said range; and (f) mixing means for mixing sets of musical tone data read from said two memories selected by said second selecting means by a ratio corresponding to said selection data, whereby a synthesized musical tone waveform is obtained from said mixing means.

6. A waveform synthesizing apparatus according to claim 5 wherein said conversion means normalizes said musical parameter within a predetermined range in accordance with said conversion curve to thereby generate said selection data.

7. A waveform synthesizing apparatus according to claim 6 further providing multiplication means for multiplying said selection data by a value corresponding to the number of sets of musical tone data stored in the selected memory group, wherein said second selecting means selects said memories within the selected memory group based on an integer part of the multiplication result of said multiplication means, while said mixing means mixes said musical tone data by a ratio corresponding to a decimal part of the multiplication result of said multiplication means.

8. A waveform synthesizing apparatus according to claim 5 wherein said musical parameter is a key code obtained from a keyboard of an electronic musical instrument.

9. A waveform synthesizing apparatus according to claim 5 wherein said musical parameter is touch data corresponding to a key-striking intensity applied to each key.

10. A waveform synthesizing apparatus according to claim 5 wherein said musical parameter is time data indicative of an elapsed time which passes from a timing when each key is depressed.

11. A waveform synthesizing apparatus which generates a synthesized musical tone waveform in response to a key-on signal, said apparatus adapted for a waveform memory read-out type electronic musical instrument, comprising:

(a) a waveform memory divided into a plurality of groups of memory areas each of which further includes a plurality of subgroups of memory areas;

(b) tone color selecting means for selecting a desirable tone color;

(c) conversion means for converting a musical parameter which is generated at key-depression and which varies over time after key-depression in accordance with a predetermined conversion characteristic into selection data which includes sub-group selection data and mixing data, wherein the value of generated selection data is in a predetermined range;

(d) sub-group selection means for selecting at least two of said sub-group selection data by which data of two waveforms are to be selected, wherein the portion of said range corresponding to one of said N memories is variable in accordance with said result and wherein the assignment density of different waveform data is variable over said range; and (e) mixing means for mixing said waveform data in accordance with said mixing data so that a synthesized waveform is obtained from mixed waveform data;

whereby a musical tone corresponding to the synthesized waveform and desirable tone color may be generated.

12. A waveform synthesizing apparatus as defined in claim 11 further comprising:

(a) key touch detecting means for detecting a key touch responsive to an operation of a key; and (b) key touch mixing means for mixing a plurality of key touch data so that mixed key touch data is delivered to said conversion means wherein said predetermined conversion characteristic is determined by the mixed key touch data.

* * * * *